US009808813B1

(12) United States Patent
Porter et al.

(10) Patent No.: US 9,808,813 B1
(45) Date of Patent: Nov. 7, 2017

(54) ROTARY STREAM SPRINKLER NOZZLE WITH OFFSET FLUTES

(71) Applicant: Hunter Industries, Inc., San Marcos, CA (US)

(72) Inventors: LaMonte D. Porter, San Marcos, CA (US); Zachary B. Simmons, San Diego, CA (US)

(73) Assignee: Hunter Industries, Inc., San Marcos, CA (US)

( * ) Notice: Subject to any disclaimer, the term of this patent is extended or adjusted under 35 U.S.C. 154(b) by 706 days.

(21) Appl. No.: 13/644,848

(22) Filed: Oct. 4, 2012

Related U.S. Application Data

(63) Continuation-in-part of application No. 11/928,579, filed on Oct. 30, 2007, now Pat. No. 8,282,022.

(51) Int. Cl.
*B05B 3/04* (2006.01)

(52) U.S. Cl.
CPC ..... *B05B 3/0422* (2013.01)

(58) Field of Classification Search
CPC ..... B05B 3/0422
USPC ..... 239/222.11, 222.13, 222.17, 203, 204, 239/240, 232, 233, 208, 206, 205, 207, 239/237, 242
See application file for complete search history.

(56) References Cited

U.S. PATENT DOCUMENTS

| | | | | |
|---|---|---|---|---|
| 1,331,255 A | | 2/1920 | Gruenberg | 239/222.19 |
| 1,764,570 A | | 6/1930 | Lohman | |
| 2,493,595 A | | 1/1950 | Rieger | 299/126 |
| 2,595,114 A | | 4/1952 | Wieseltier | 239/97 |
| 3,111,268 A | | 11/1963 | Butler | 239/170 |
| 3,131,867 A | | 5/1964 | Miller et al. | 239/97 |
| 3,854,664 A | | 12/1974 | Hunter | 239/206 |
| 3,888,417 A | | 6/1975 | Harmon | 239/97 |
| 4,272,024 A | | 6/1981 | Kah, Jr. | 239/206 |
| 4,353,506 A | | 10/1982 | Hayes | 239/206 |
| 4,356,972 A | * | 11/1982 | Vikre | A01G 25/092 239/173 |
| 4,471,908 A | | 9/1984 | Hunter | 239/11 |
| 4,815,662 A | | 3/1989 | Hunter | 239/222 |
| 4,842,201 A | | 6/1989 | Hunter | 239/396 |
| 4,867,379 A | | 9/1989 | Hunter | 239/240 |
| 4,898,332 A | | 2/1990 | Hunter et al. | 239/240 |
| 4,932,590 A | | 6/1990 | Hunter | 239/222 |
| 4,967,961 A | | 11/1990 | Hunter et al. | 239/240 |
| 4,971,250 A | | 11/1990 | Hunter | 239/222.17 |

(Continued)

*Primary Examiner* — Arthur O Hall
*Assistant Examiner* — Steven M Cernoch
(74) *Attorney, Agent, or Firm* — Knobbe Martens Olson & Bear, LLP

(57) ABSTRACT

A sprinkler nozzle includes a nozzle plate having at least one orifice formed therein. A stream deflector is rotatably mounted adjacent the nozzle plate and has a plurality of flutes formed therein that face the nozzle plate. Each flute has an inner portion that can momentarily align with water flowing through the orifice in the nozzle plate during rotation of the stream deflector relative to the nozzle plate. Water flowing through the orifice will be channeled in a generally radial direction by the flute to form a stream of water that is ejected from the stream deflector. The flutes have a plurality of different tangential trajectories relative to the orifice in the nozzle plate so that in combination the streams of water successively ejected from the stream deflector establish a predetermined shape of coverage.

13 Claims, 24 Drawing Sheets

(56) References Cited

U.S. PATENT DOCUMENTS

| | | | | |
|---|---|---|---|---|
| 4,986,474 | A * | 1/1991 | Schisler et al. | 239/205 |
| 5,058,806 | A | 10/1991 | Rupar | 239/205 |
| 5,288,022 | A | 2/1994 | Sesser | 239/205 |
| 5,372,307 | A | 12/1994 | Sesser | 239/210 |
| 5,375,768 | A | 12/1994 | Clark | |
| 5,423,486 | A | 6/1995 | Hunter | |
| 5,456,411 | A | 10/1995 | Scott et al. | |
| 5,556,036 | A | 9/1996 | Chase | |
| 5,699,962 | A | 12/1997 | Scott et al. | |
| 5,711,486 | A | 1/1998 | Clark et al. | |
| 5,718,381 | A | 2/1998 | Katzer et al. | 239/222.11 |
| 5,720,435 | A | 2/1998 | Hunter | |
| 5,761,886 | A | 6/1998 | Parkhideh | 53/454 |
| 5,762,270 | A | 6/1998 | Kearby et al. | |
| 5,845,849 | A * | 12/1998 | Mitzlaff | 239/203 |
| 5,918,812 | A | 7/1999 | Beutler | |
| 5,927,607 | A | 7/1999 | Scott | |
| 5,988,523 | A | 11/1999 | Scott | |
| 6,042,021 | A | 3/2000 | Clark | |
| 6,050,502 | A | 4/2000 | Clark | |
| 6,082,632 | A | 7/2000 | Clark et al. | |
| 6,138,924 | A | 10/2000 | Hunter et al. | |
| 6,227,455 | B1 | 5/2001 | Scott et al. | |
| 6,241,158 | B1 | 6/2001 | Clark et al. | |
| 6,244,521 | B1 | 6/2001 | Sesser | 239/222.17 |
| 6,299,075 | B1 | 10/2001 | Koller | |
| 6,457,656 | B1 | 10/2002 | Scott | |
| 6,491,235 | B1 | 12/2002 | Scott et al. | |
| 6,499,672 | B1 | 12/2002 | Sesser | 239/222.11 |
| 6,651,904 | B2 * | 11/2003 | Roman | 239/204 |
| 6,651,905 | B2 | 11/2003 | Sesser | 239/205 |
| 6,688,539 | B2 | 2/2004 | Griend | 239/222.11 |
| 6,695,223 | B2 | 2/2004 | Beutler et al. | |
| 6,736,332 | B2 | 5/2004 | Sesser et al. | 239/204 |
| 6,814,304 | B2 | 11/2004 | Onofrio | 239/201 |
| 6,817,543 | B2 | 11/2004 | Clark | |
| 6,854,664 | B2 | 2/2005 | Smith | |
| 6,871,795 | B2 | 3/2005 | Anuskiewicz | |
| 6,957,782 | B2 | 10/2005 | Clark et al. | |
| 7,032,836 | B2 | 4/2006 | Sesser et al. | 239/204 |
| 7,040,553 | B2 | 5/2006 | Clark | |
| D527,791 | S | 9/2006 | Onofrio et al. | D23/214 |
| 7,100,842 | B2 | 9/2006 | Meyer et al. | 239/214 |
| 7,143,957 | B2 | 12/2006 | Nelson | 239/222.21 |
| 7,159,795 | B2 | 1/2007 | Sesser et al. | 239/203 |
| 7,240,860 | B2 | 7/2007 | Griend | |
| 7,255,291 | B1 | 8/2007 | Lo | 239/242 |
| 7,287,711 | B2 | 10/2007 | Crooks | |
| 7,303,147 | B1 | 12/2007 | Danner et al. | |
| 7,322,533 | B2 | 1/2008 | Grizzle | |
| D593,182 | S | 5/2009 | Anuskiewicz | |
| 7,530,504 | B1 | 5/2009 | Danner et al. | |
| 7,611,077 | B2 | 11/2009 | Sesser et al. | |
| 7,621,467 | B1 | 11/2009 | Garcia | |
| 7,677,469 | B1 | 3/2010 | Clark | |
| 7,748,646 | B2 | 7/2010 | Clark | |
| 7,828,230 | B1 | 11/2010 | Anuskiewicz et al. | |
| 7,861,948 | B1 | 1/2011 | Crooks | |
| 8,220,723 | B2 | 7/2012 | Clark | |
| 8,272,578 | B1 | 9/2012 | Clark et al. | |
| 2004/0262426 | A1 | 12/2004 | Antonucci et al. | 239/233 |
| 2005/0133619 | A1 | 6/2005 | Clark | |
| 2007/0029414 | A1 | 2/2007 | Tilton et al. | 239/589 |
| 2008/0230628 | A1 | 9/2008 | Alexander | 239/205 |
| 2008/0277489 | A1 | 11/2008 | Townsend | 239/7 |
| 2009/0224070 | A1 | 9/2009 | Clark et al. | |
| 2011/0024522 | A1 | 2/2011 | Anuskiewicz | |
| 2012/0024982 | A1 | 2/2012 | Dunn et al. | |
| 2012/0043398 | A1 | 2/2012 | Clark | |
| 2012/0132727 | A1 | 5/2012 | Dunn et al. | |
| 2012/0234940 | A1 | 9/2012 | Clark et al. | |

* cited by examiner

ROTARY STREAM SPRINKLER NOZZLE WITH OFFSET FLUTES

CROSS-REFERENCE TO RELATED APPLICATION

This application is a continuation-in-part of the similarly entitled pending U.S. patent application Ser. No. 11/928,579 filed Oct. 30, 2007, the entire disclosure of which is specifically incorporated herein by reference.

FIELD OF THE INVENTION

The present invention relates to sprinklers used to irrigate turf and landscaping, and more particularly, to rotary stream irrigation sprinklers that eject relatively small individuals streams of water.

BACKGROUND OF THE INVENTION

Many geographic locations have insufficient rainfall or dry spells that require turf and landscaping to be watered to maintain the proper health of the vegetation. Turf and landscaping are often watered utilizing an automatic irrigation system that includes a programmable controller that turns a plurality of valves ON and OFF to supply water through underground pipes connected to sprinklers. Golf courses, playing fields and other large areas typically require rotor-type sprinklers that eject a long stream of water via a single relatively large nozzle that oscillates through an adjustable arc. Smaller areas are often watered with spray heads or rotary stream sprinklers. Spray heads eject a fan-shaped pattern of water at a relatively high rate and much of this water often flows off the vegetation and/or blows away and is wasted. Rotary stream sprinklers eject relatively small individual streams of water and use less water than spray head sprinklers. In some cases drip nozzles are employed in residential and commercial irrigation systems for watering trees and shrubs, for example.

Rotary stream sprinklers sometimes incorporate a turbine and gear train reduction for slowly rotating the nozzle head or stream deflector. The turbine is typically located at the bottom of the sprinkler, below the gear box that holds the gear train reduction, and above the stator where one is employed. A rotary stream sprinkler can also use the water to directly power the stream deflector, in which case the flutes formed on the underside of the stream deflector that form and channel the streams of water are angled so that a rotational force on the stream deflector is generated. Where the water directly provides the rotary force to the stream deflector, a brake or damper is employed to slow the rate of rotation of the stream deflector.

FIG. 1 illustrates a stream deflector 2 of a conventional rotary stream sprinkler. The inner end of each of the flutes 4 terminates adjacent, and is aligned with, the rotational axis 6 of the stream deflector 2. Rotary stream sprinklers typically include a nozzle plate 8 (FIG. 2) with a suitably shaped orifice 10 that directs water onto the underside of the stream deflector 2 so that the streams only fall onto the desired shape of coverage, e.g. a ninety degree arc in the example shown. In another conventional rotary stream sprinkler the nozzle plate 12 (FIG. 3) has a cylindrical configuration with multiple orifices 14, 16 and 18 that are either open, have varying degrees of restriction, or are plugged. In yet another conventional rotary stream sprinkler 20 (FIG. 4) the nozzle plate 22 has an arcuate orifice 24. Selected amounts of the orifice 24 can be blocked by inserting a plug 26 of suitable size so that the shape of coverage can be adjusted.

The principal drawback of prior rotary stream sprinklers is that they cannot accurately, uniformly and reliably deliver a predetermined very low precipitation rate over a desired shape of coverage. By way of example, a conventional rotary stream sprinkler designed to provide a ninety degree arc of coverage would require an arcuate orifice in the nozzle plate only six thousandths of an inch wide in order to achieve a flow rate of 3.6 gallons per hour at a typical water pressure of between about 20 PSI and 50 PSI. Such a tiny orifice would soon become blocked by grit and/or mineral deposits. Mover, it would be difficult to rotate the stream deflector of a conventional rotary stream sprinkler at such a low flow rate.

SUMMARY OF THE INVENTION

According to the present invention, a sprinkler nozzle includes a nozzle plate having at least one orifice formed therein. A stream deflector is rotatably mounted adjacent the nozzle plate and has a plurality of flutes formed therein that face the nozzle plate. Each flute has an inner portion that can momentarily align with water flowing through the orifice in the nozzle plate during rotation of the stream deflector relative to the nozzle plate. Water flowing through the orifice will be channeled in a generally radial direction by the flute to form a stream of water that is ejected from the stream deflector. The flutes have a plurality of different tangential trajectories relative to the orifice in the nozzle plate so that in combination the streams of water successively ejected from the stream deflector establish a predetermined shape of coverage.

BRIEF DESCRIPTION OF THE DRAWINGS

FIG. 7 illustrates a different shape of the nozzle plate than the other figures.

In FIGS. 14B, 15B and 16B the flutes on the underside of the stream deflector are illustrated in phantom lines.

DETAILED DESCRIPTION

Figure 5:
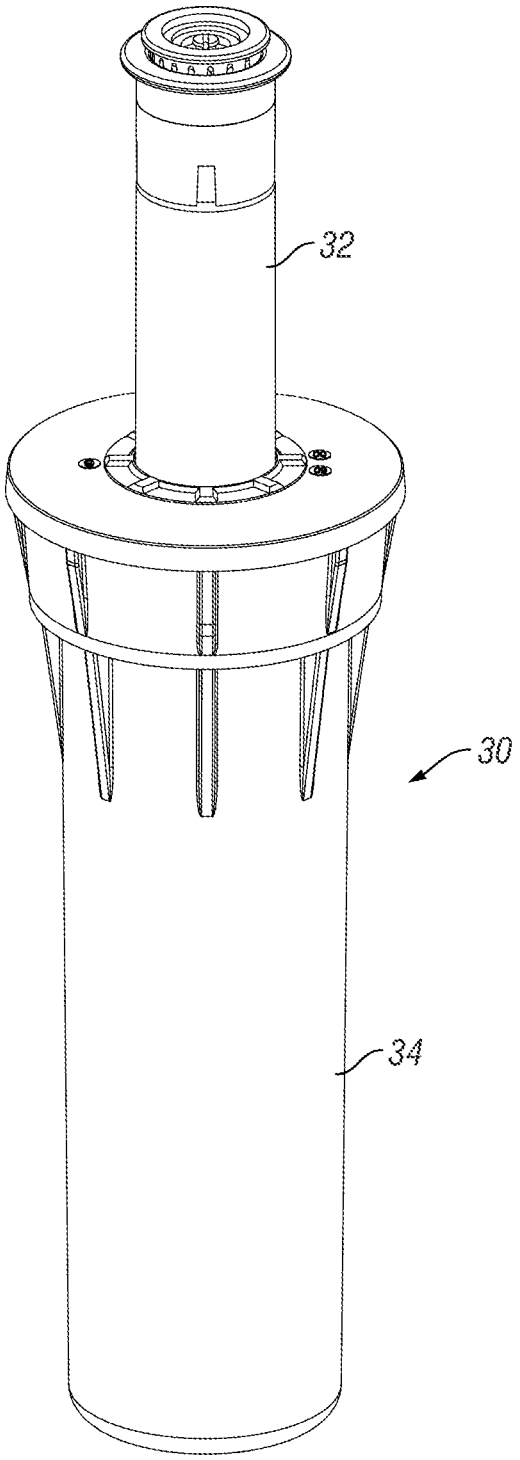
FIG. 5 is a perspective view of a pop-up rotary stream sprinkler incorporating an embodiment of the present invention with its riser extended.
Figure 6:
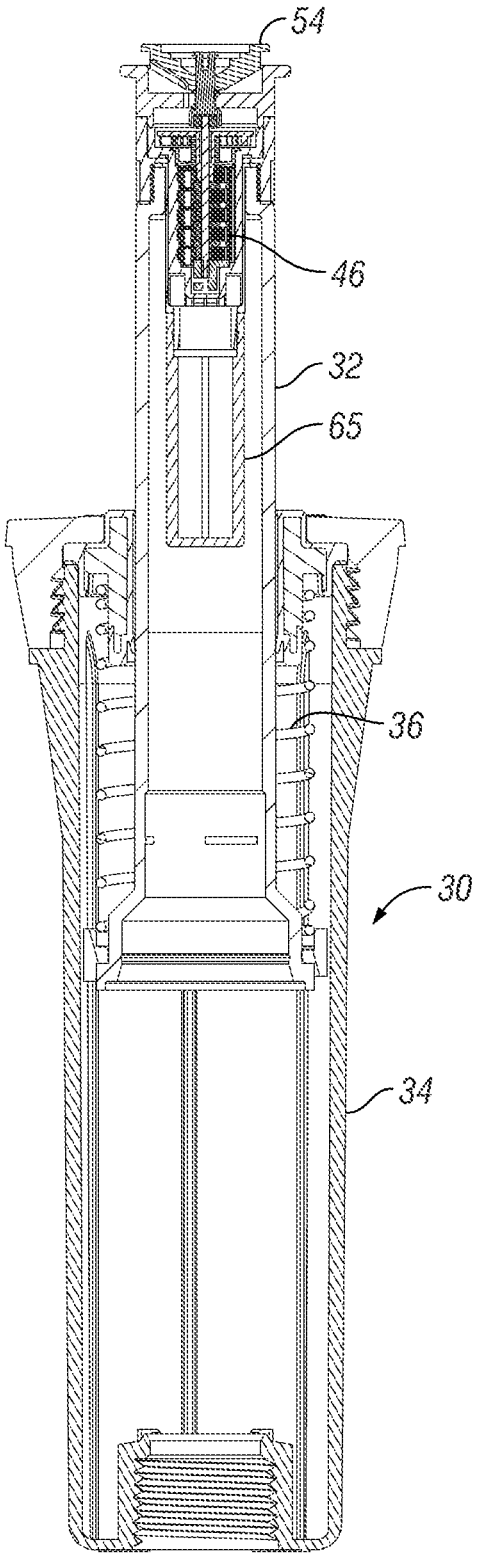
FIG. 6 is a vertical sectional view of the rotary stream sprinkler of FIG. 5 with its riser extended.
Figure 7:
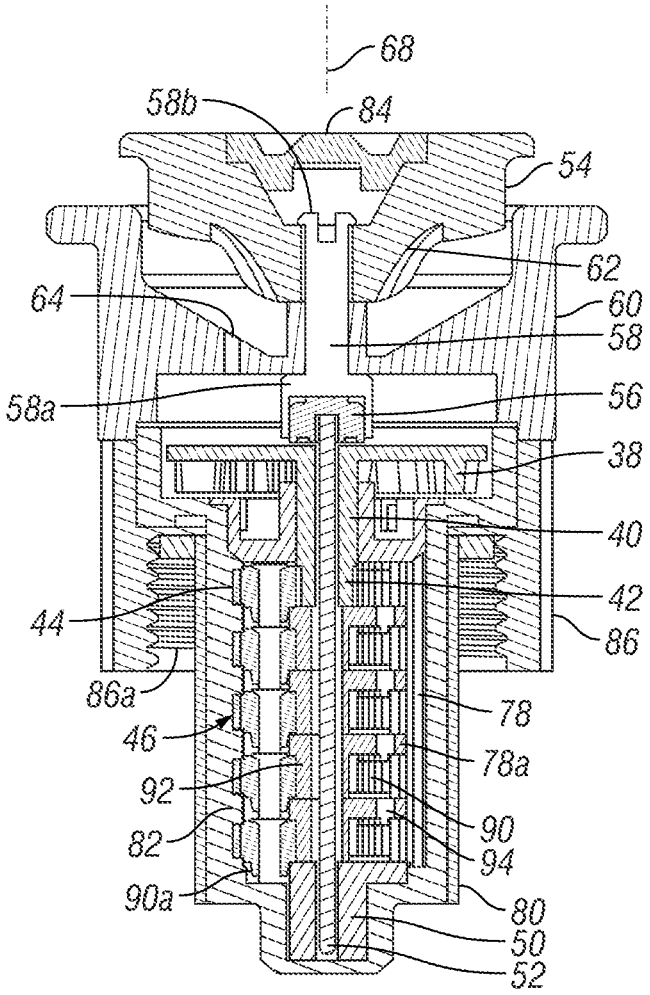
FIG. 7 is an enlarged portion of FIG. 6 illustrating details of the nozzle, turbine and planetary gear train reduction mounted in the upper portion of the riser of the rotary stream sprinkler of FIGS. 5 and 6.
Figure 8:
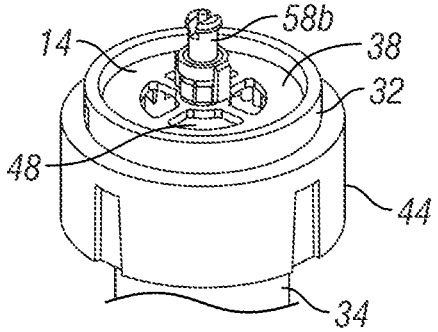
FIG. 8 is an enlarged fragmentary perspective view illustrating details of the upper end of the riser of the rotary stream sprinkler of FIG. 5.

Referring to FIG. 5, in accordance with an embodiment of the present invention, a pop-up rotary stream sprinkler 30 comprises a tubular riser 32 that telescopes within a cylindrical outer case 34 and is normally held in a retracted position by a coil spring 36 (FIG. 6). A turbine 38 (FIG. 7) is supported for high speed rotation within an upper portion of the riser 32. The turbine 38 is integrally formed with a hollow central shaft 40 having a pinion gear 42 that drives an upper input stage 44 of a planetary gear train reduction 46. Water can flow through apertures 48 (FIG. 8) in the turbine 38. The gear train reduction 46 (FIG. 7) has a lower output stage 50 that is rigidly coupled to the lower end of a drive shaft 52. The drive shaft 52 extends through the axial center of the gear train reduction 46 and loosely through turbine 38. The upper end of the drive shaft 52 is coupled to a stream deflector 54 via clutch dog 56 and clutch member 58. The clutch dog 56 is rigidly coupled to the upper end of the drive shaft 52. The clutch member 58 has a clutch cup 58*a* (FIG. 11) at its lower end with four resilient fingers that grip the clutch dog 56 but release when the stream deflector 54 is manually rotated by a vandal, for example, to prevent damage to the gear train reduction 46 by back driving the same. The upper end of the clutch member 58 is formed with a retaining head 58*b* with a tapered peripheral lip and a diametric slot so that that the stream deflector 54 can be snap fit over the retaining head 58*b* as best seen in FIG. 7. The clutch dog 56, clutch member 58 and drive shaft 52 provide a means for drivingly connecting the output stage 50 of the gear train reduction 46 and the stream deflector 54.

Figure 1:
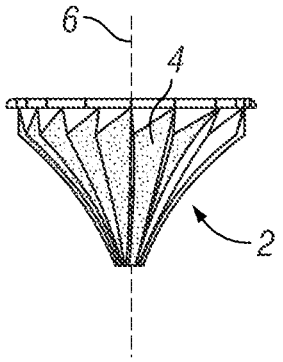
FIG. 1 (Prior Art)
FIG. 1 is a side elevation view of a stream deflector of a conventional rotary stream sprinkler.
Figure 2:
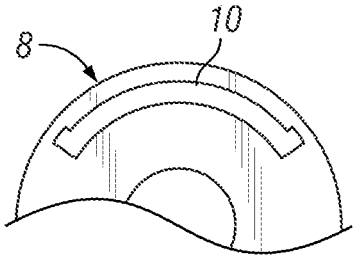
FIG. 2 (Prior Art)
FIG. 2 is a plan view of a nozzle plate of a conventional rotary stream sprinkler, the nozzle plate having an arcuate shaped orifice.
Figure 3:
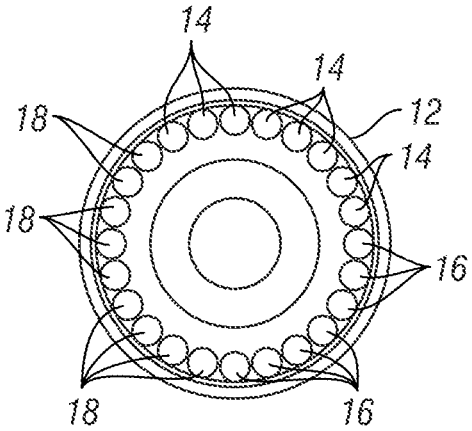
FIG. 3 (Prior Art)
FIG. 3 is a plan view a nozzle plate of another conventional rotary stream sprinkler, the nozzle plate having multiple orifices.
Figure 4:
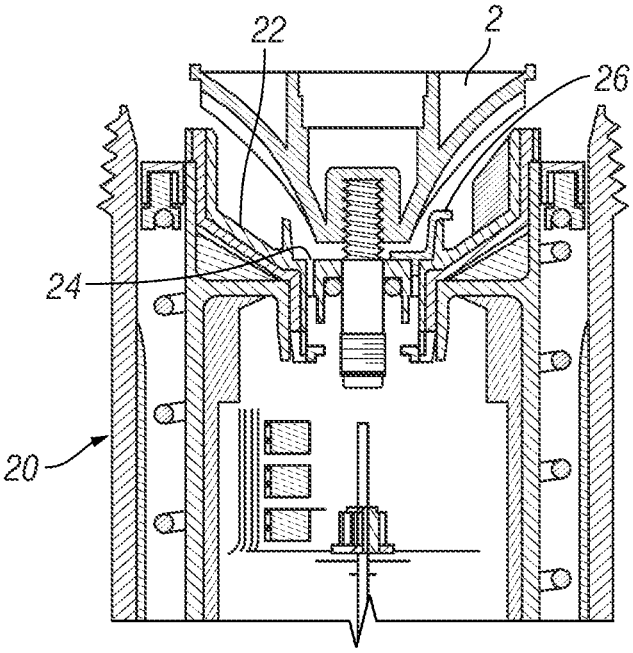
FIG. 4 (Prior Art)
FIG. 4 is a fragmentary vertical sectional view of another conventional rotary stream sprinkler having a nozzle plate with an arcuate orifice that is partially blocked by a plug to establish the shape of coverage of the sprinkler.

Referring still to FIG. 7, the turbine 38 is located at the top of the sprinkler 30 between a nozzle plate 60 and the gear train reduction 46. The location of the turbine 38 at the top of the rotary stream sprinkler 30 has particular advantages that are explained hereafter. Bearings or seals 61*a* and 61*b* (FIG. 13) surround the clutch member 58 on either side of the nozzle plate 60. While the gear train reduction 46 has the configuration of a planetary gear drive, other forms of gear train reduction could also be used such as a staggered gear train reduction of the type illustrated in FIG. 4 of pending U.S. patent application Ser. No. 11/846,480 filed Aug. 28, 2007, of Ronald H. Anuskiewicz et al., assigned to Hunter Industries, Inc., hereby incorporated by reference, for example.

Together the nozzle plate 60 and the stream deflector 54 provide a sprinkler nozzle with a unique manner of distributing water in a desired pattern which is referred to herein as a shape of coverage. Referring to FIGS. 10-13, the stream deflector 54 is generally round with an inverted frustoconical configuration. A plurality of generally radially extending grooves, channels or flutes 62 (FIGS. 11 and 13) are formed on the underside of the stream deflector 54. The flutes 62 are upwardly inclined and are capable of ejecting successive streams of water that extend at different lateral angles. The flutes 62 are vertically inclined relative to a horizontal plane orthogonally intersecting the vertical rotational axis 68 (FIG. 7) of the stream deflector 54. The angle of vertical inclination of the flutes 62 can be varied to produce the desired shape of coverage and/or to change the radius or reach of the streams of water ejected by the stream deflector 54.

The nozzle plate 60 is generally cylindrical and has a round orifice 64 (FIGS. 7 and 13) formed therein. The size of the orifice 64 may be 0.028 inches in diameter, so that the rotary stream sprinlder 30 has a very low rate of precipitation, e.g. 3.6 gallons per hour, when the sprinlder 30 is coupled to a source of water pressurized between about 20 and 50 PSI. However, the size of the orifice 64 is large enough to resist clogging via grit and mineral deposits. The rotary stream sprinlder 30 includes a screen 65 (FIG. 6) to filter out debris and help reduce clogging of the orifice 64 in the nozzle plate 60.

Figure 13:
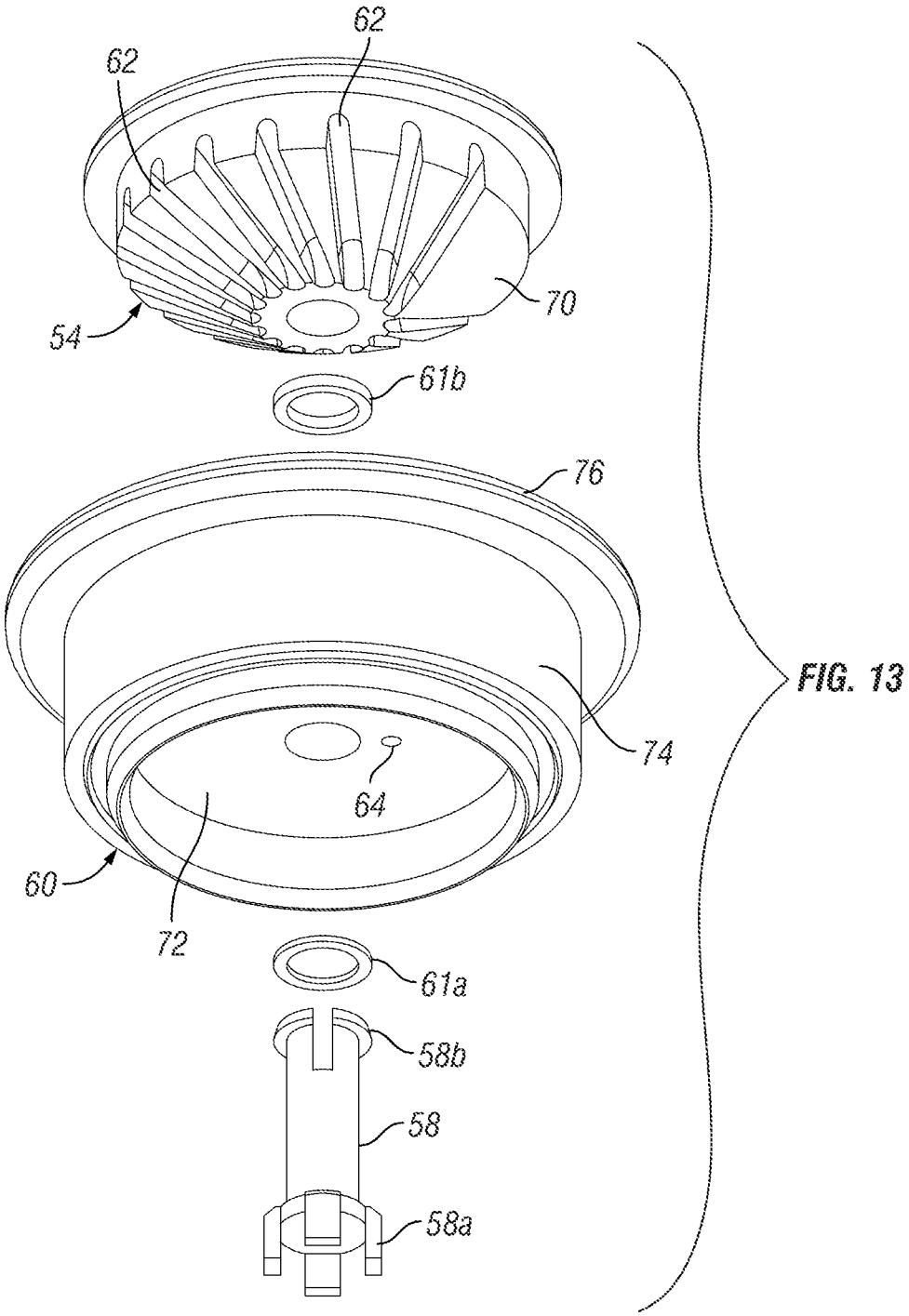
FIG. 13 is a slightly reduced exploded perspective view of the nozzle plate and stream deflector of FIG. 10 taken from the bottom side of FIG. 10.
Figure 14A:
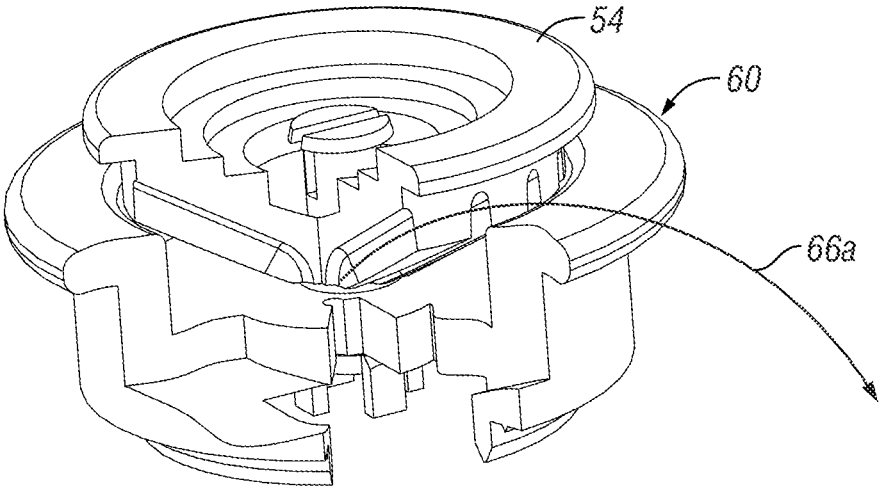
FIGS. 14A, 14B, 15A, 15B, 16A and 16B are a series of fragmentary perspective (the A figures) and fragmentary top plan views (the B figures), illustrating the manner in which the nozzle plate and stream deflector of FIG. 10 successively eject streams of water at different angles that when added together establish a predetermined shape of coverage.

The stream deflector 54 is rotatably mounted adjacent the nozzle plate 60 so that the plurality of flutes 62 face the nozzle plate 60. Each flute 62 opens downwardly and has an inner portion 62*a* (FIG. 11) that momentarily aligns with the orifice 64 in the nozzle plate 60 during rotation of the stream deflector 54 relative to the nozzle plate 60. All that is necessary is that the inner portion 62*a* of each flute 62 momentarily align with the stream of water ejected from the orifice 64 in the nozzle plate 60. During this momentary alignment, water flowing through the orifice 64 will be channeled in a generally radial direction by the flute 62 to form a stream of water 66*a* (FIGS. 14A and 14B) that is ejected from the stream deflector 54, usually onto adjacent vegetation such as turf or shrubs. The rotary stream sprinkler 30 can also be employed in connection with watering artificial turn where water is applied for cooling or to disperse a germicide. As best seen in FIG. 13, the flutes 62 have a plurality of different lateral trajectories (viewed from above) relative to the orifice 64 in the nozzle plate 60 so that in combination the sum of the streams of water 66 that are successively ejected from the stream deflector 54 establish a predetermined shape of coverage.

Figure 11:
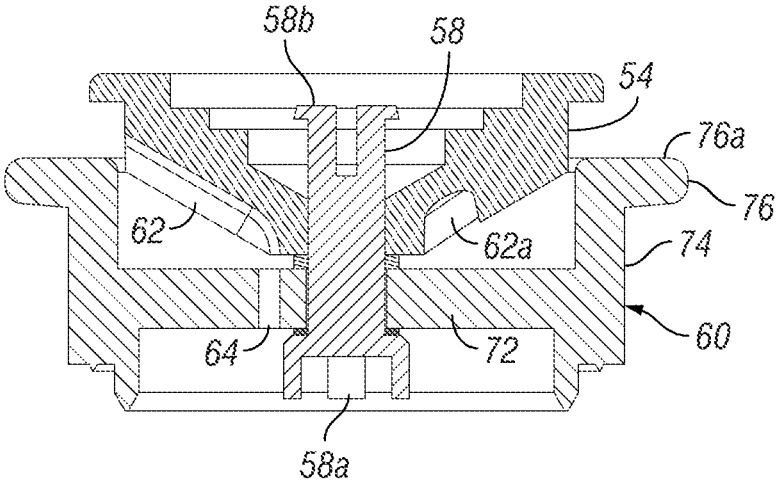
FIG. 11 is a vertical sectional view of the nozzle plate and stream deflector taken along line 11-11 of FIG. 10.
Figure 12:
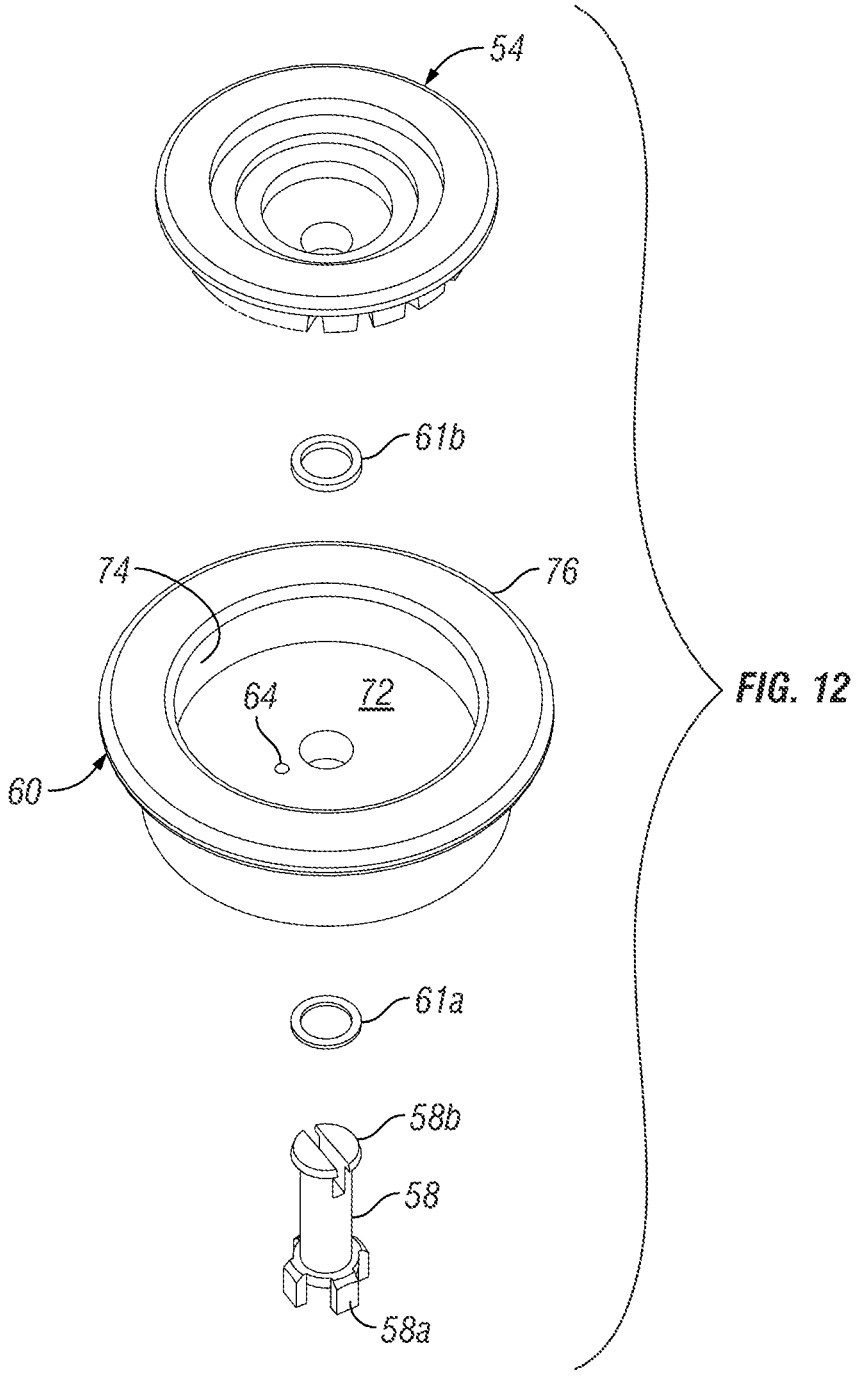
FIG. 12 is a slightly reduced exploded perspective view of the nozzle plate and stream deflector of FIG. 10 taken from the top side of FIG. 10.
Figure 14B:
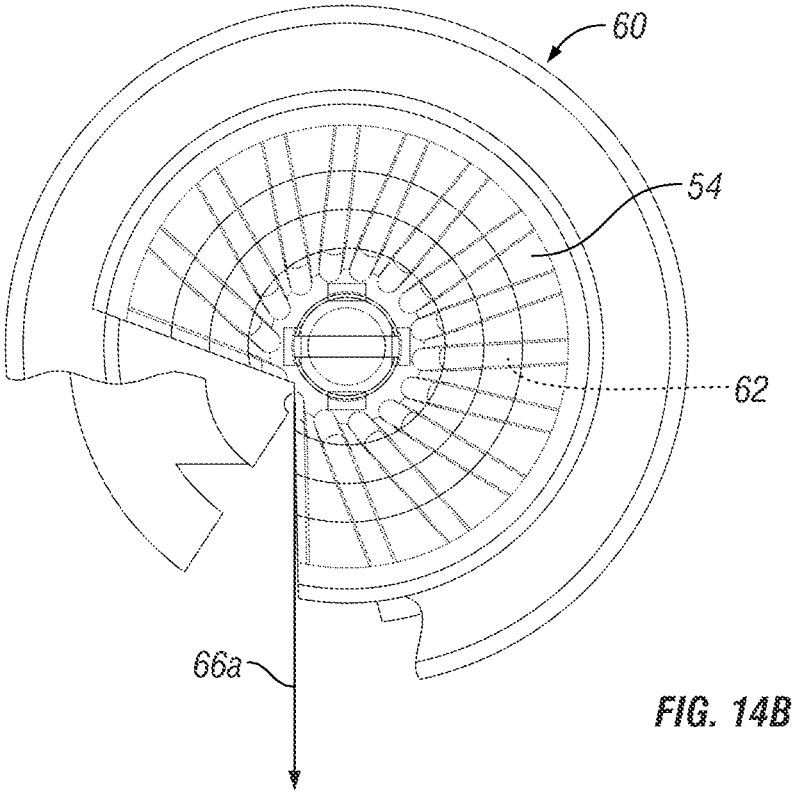
Figure 15A:
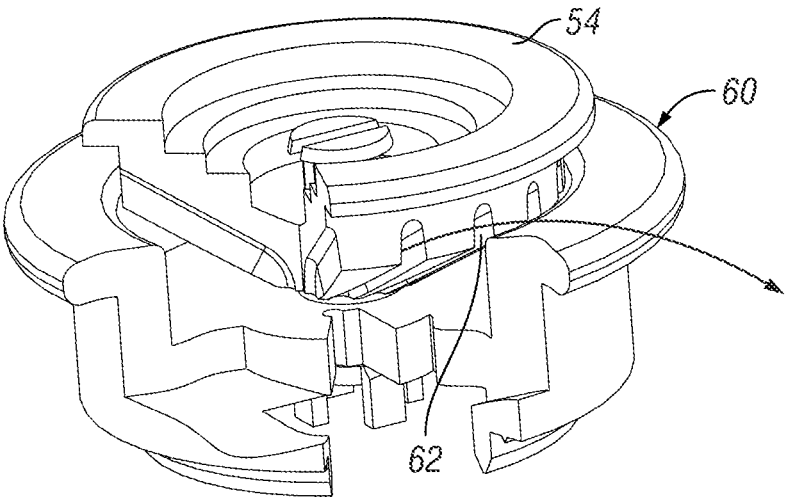
Figure 15B:
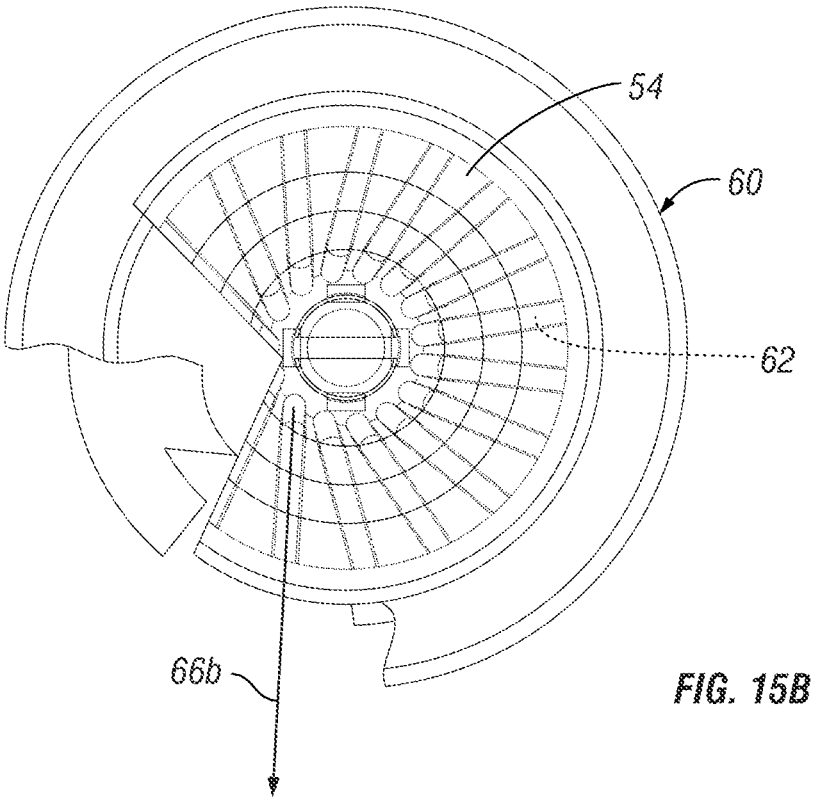
Figure 16A:
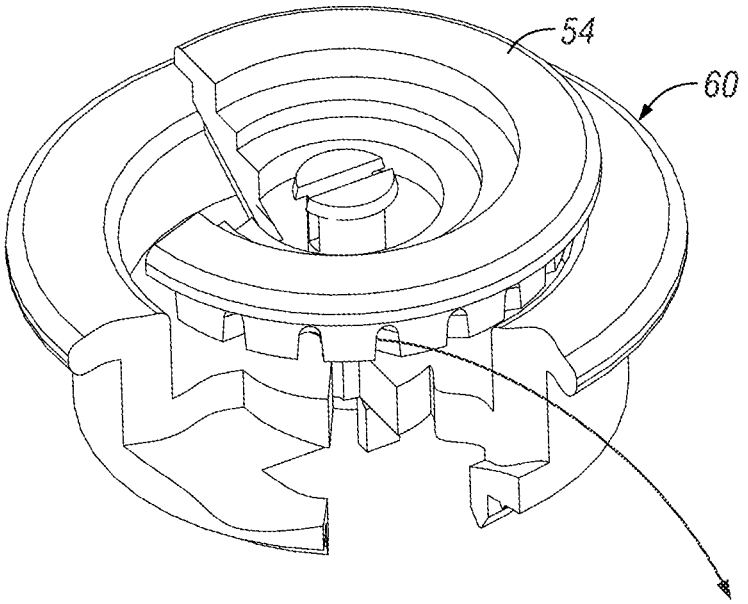
Figure 16B:
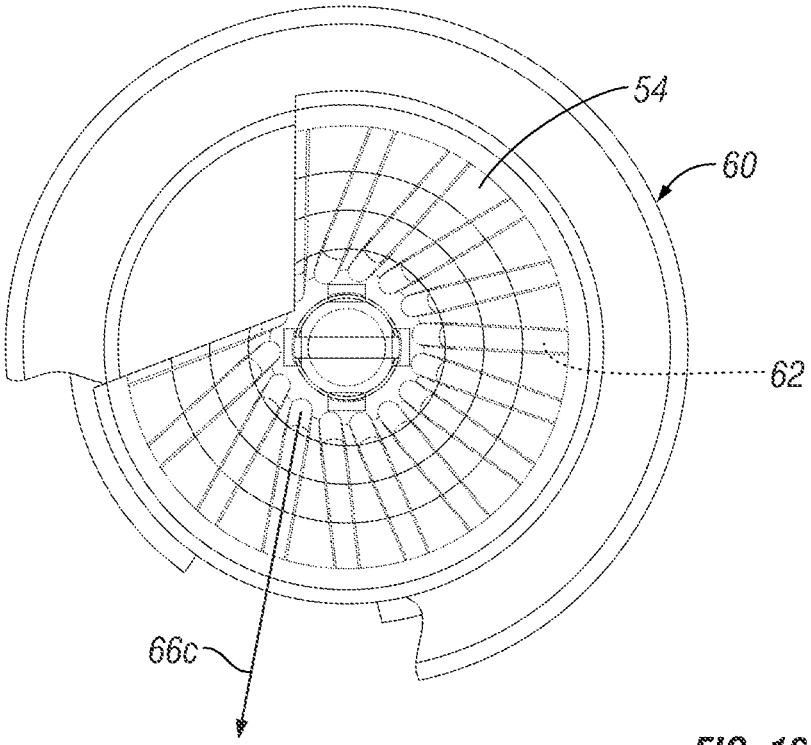

The flutes 62 are formed so that successive streams of water 66*a* (FIGS. 14A and 14B), 66*b* (FIGS. 15A and 15B), and 66*c* (FIGS. 16A and 16B) extend at different lateral angles as the stream deflector 54 continuously rotates at a relatively slow speed, e.g. preferably less than one RPM. The trajectories of the successive streams of water progress so that eventually water has been supplied over all of the desired shape of coverage. The flutes 62 have a generally hemispherical cross-section as illustrated in FIGS. 11 and 13. The flutes 62 are generally straight and the axis of each flute does not intersect the vertical rotational axis 68 (FIG. 7) of the stream deflector 54. The flutes 62 could have other cross-sectional shapes besides hemispherical, including V-shaped, rectangular, oval, and so forth. As illustrated in FIG. 13, the flutes 62 extend in a tangential fashion relative to the rotational center of the stream deflector 54. The orifice 64 in the nozzle plate 60 is radially offset from the rotational axis 68 of the stream deflector 54. Each flute 62 is angled relative to the orifice 64, instead of the rotational axis 68. A portion 70 of the underside of the stream deflector 54 has a generally smooth surface and extends between the flutes 62. A first flute on one side of the generally smooth surface in angled in one direction and distributes water to one define the first side of the shape of coverage. A second flute on the opposite side of the generally smooth area is angled in another direction and distributes water to define the other side of the shape of coverage. The water from the first flute in emitted in a significantly different direction than the water from the second flute such that the area of coverage at the furthest most reaches of the streams of water from the first flute and the second flute do not overlap Viewed from the top of the stream deflector 54 as shown in FIG. 14B, it can be seen that in the embodiment illustrated, the angle between adjacent flutes 62 progressively increases as the flutes 62 get nearer to the smooth portion 70. The number, angle and placement of the flutes 62, together with the size of the smooth portion 70 determine the size of the shape of coverage of the rotary stream sprinkler 30, e.g. ninety degrees, one hundred and eighty degrees, and so forth. The size of the shape of coverage produced by the nozzle comprising the rotating novel stream deflector 54 and the nozzle plate 60 is independent of the size, shape, and location of the nozzle orifice in the nozzle plate 60 in contrast to conventional rotary stream sprinklers. The shape of coverage produced by the stream deflector 54 and the orifice 64 in the nozzle plate 60 is solely determined by the trajectory of the flutes 62 formed in the underside of the stream deflector 54.

Each flute 62 contributes to watering a specific portion of the desired shape of coverage. Only a single stream of water is ejected at any one time. This is to be contrasted with conventional rotary stream sprinklers that utilize a combination of broken and unbroken streams that are ejected simultaneously to fill in the shape of coverage. As each flute 62 comes into alignment with the stream of water ejected from the orifice 64 and goes out of alignment with the stream of water ejected from the orifice 64, the stream will effectively be turned On and OFF and water in the stream will gradually reach all the way out to the maximum radius and then all the way in, watering a sector along a radius that extends from the rotary stream sprinkler 30. In addition the vertical inclination of the flutes 62 can be varied so that the streams of water 66*a*, etc. will cover areas closer in or farther out from the rotary stream sprinkler 30. Also stream interrupters (not shown) can be employed to ensure that regions close to the rotary stream sprinkler 30 will receive adequate water.

The orifice 64 may be circular, or it may have another shape. The orifice 64 can be sized so that less than about eight gallons of water per hour will be ejected onto a predetermined shape of coverage at a pressure of between about 20 PSI and 50 PSI. Based on information and belief, this is less than the minimum precipitation rate of any conventional rotary stream sprinkler that has heretofore been commercialized. A preferred embodiment of the rotary sprinkler 30 delivers approximately 3.6 gallons of water per hour over a ninety degree arc of coverage using a round nozzle orifice 64 having a diameter of 0.028 inches.

The nozzle plate 60 has a central disk portion 72 (FIG. 11) with the orifice 64 formed therein, and a surrounding cylindrical collar 74 that terminates in an annular lip 76. The upper edge 76*a* has a curved inner shoulder and terminates just below the distal portions of the flutes 62 so that the streams of water ejected from the flutes 62 at an upward angle clear the nozzle plate 60. The term "nozzle plate" refers to any structure having a least one orifice for directing water onto the stream deflector and it need not be flat or have the stepped cylindrical configuration illustrated in FIGS. 11 and 12. The nozzle plate could have a configuration similar to one of those disclosed in the U.S. patents listed above that are incorporated herein by reference.

Figure 9:
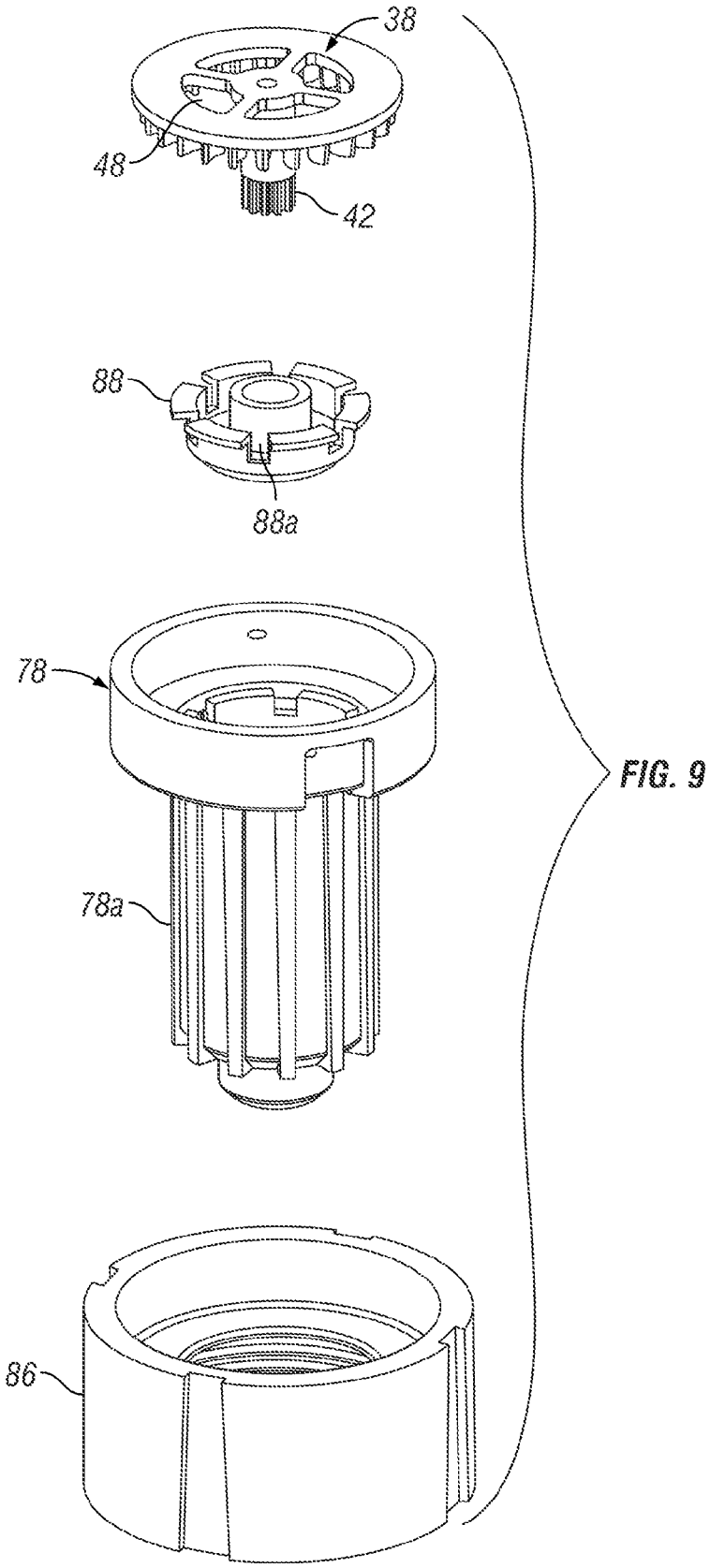
FIG. 9 is an exploded perspective view of the nozzle base, gear box, by-pass flow member and turbine of the rotary stream sprinkler of FIGS. 5 and 6.
Figure 10:
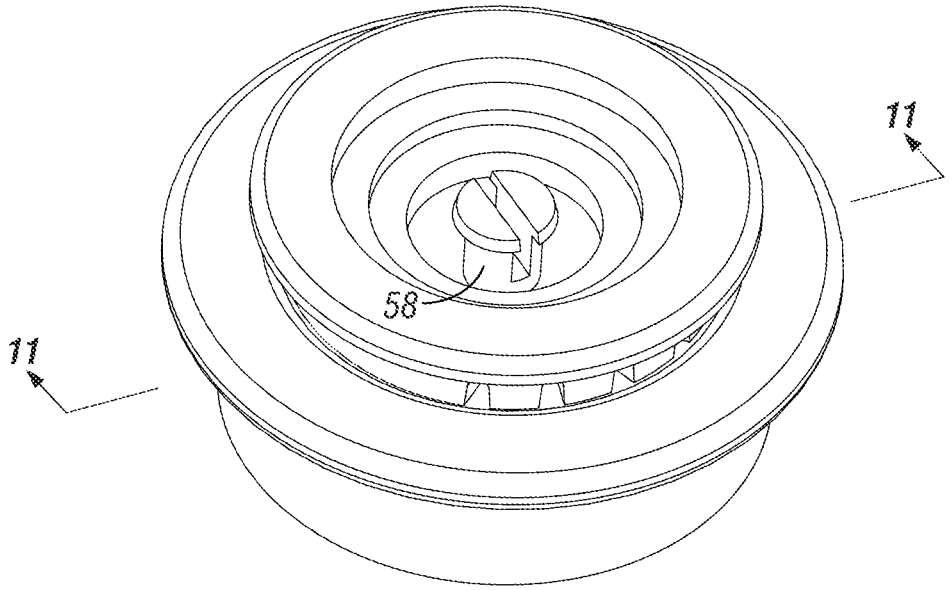
FIG. 10 is an enlarged perspective view of the nozzle plate and stream deflector of the rotary stream sprinkler of FIG. 5 taken from the top of FIG. 5.

The gear drive train reduction 46 is enclosed in a gear box 78 (FIGS. 7 and 9) having a ring gear 78*a* formed on an interior surface of a lower portion thereof. A cylindrical housing 80 (FIG. 7) surrounds and supports the gear box 78 and defines a primary flow path 82 leading to the turbine 38. A screen retainer (not illustrated in FIG. 7) snap fits into the lower end of the housing 80 and removably receives the screen 65 (FIG. 6) that filters dirt and other debris. A cap 84 snap fits into the top side of the stream deflector 54.

A cylindrical nozzle base 86 (FIG. 7) surrounds the turbine 38 and the gear train reduction 46. The nozzle base 86 has a female threaded segment 86*a* for screwing over the male threaded upper segment of the riser 32 (FIG. 6). The nozzle base 86 could also be screwed over the male threaded upper segment of a fixed riser in which case the sprinkler would not be in a pop-up configuration. The nozzle base 86 could instead have a male threaded segment for screwing over a female threaded upper segment of a fixed riser.

The rotary stream sprinkler 30 has a secondary flow path that includes small radial channels 88*a* (FIG. 9) in a by-pass flow member 88. The size, number, shape and/or arrangement of the channels 88*a* can be changed to adjust the flow rate to the turbine 38. The gear train reduction 46 includes planet gears 90 (FIG. 7) and sun gears 92. Each sun gear 92 is integrally formed in the center of a circular carrier 94. The planet gears 90 have posts 90*a* that extend downwardly from the same and rotate in round holes formed in the corresponding circular carrier 94. The planet gears 90 engage the ring gear 78*a* formed on the interior of the lower segment of the gear box 78 and also engage the corresponding sun gear 92. Preferably the planetary gear train reduction 46 reduces the RPM of the turbine 38, which is typically several hundred, down to less than one RPM.

The novel combination of the stream deflector 54, nozzle plate 60, gear train reduction 46 and nozzle base 86 is modular in the sense that this assembly can be manufactured with varying water distribution patterns and/or flow rates and can be conveniently screwed into the top of a fixed riser instead of a conventional spray head. This assembly can also be screwed into the riser of a pop-up spray-type sprinkler. Locating the turbine 38 above the gear train reduction 46 eliminates the pressure difference that otherwise tends to cause dirt and other debris to enter the gear box 78. The top placement of the turbine 38 reduces adverse effects of water and air surges that can damage a turbine located at the lower end of a sprinkler. Locating the turbine 38 at the top of the rotary stream sprinkler 30 also allows the turbine 38 to have a larger diameter which produces a larger drive force for the stream deflector 54. The additional water flow needed for large radius or arc of coverage does not have to flow around the turbine 38, thereby providing increased torque.

Figure 17:
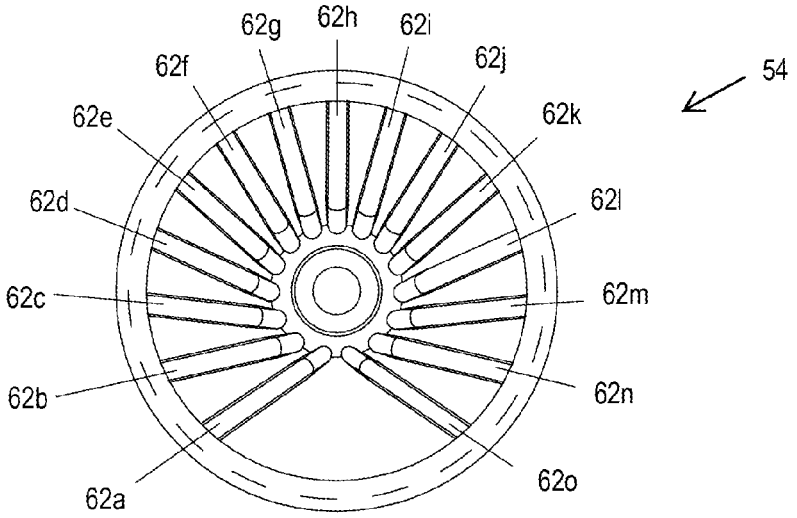
FIG. 17 is an enlarged bottom plan view of the stream deflector of FIGS. 10-13 that produces the water distribution pattern illustrated in FIG. 18.
Figure 18:
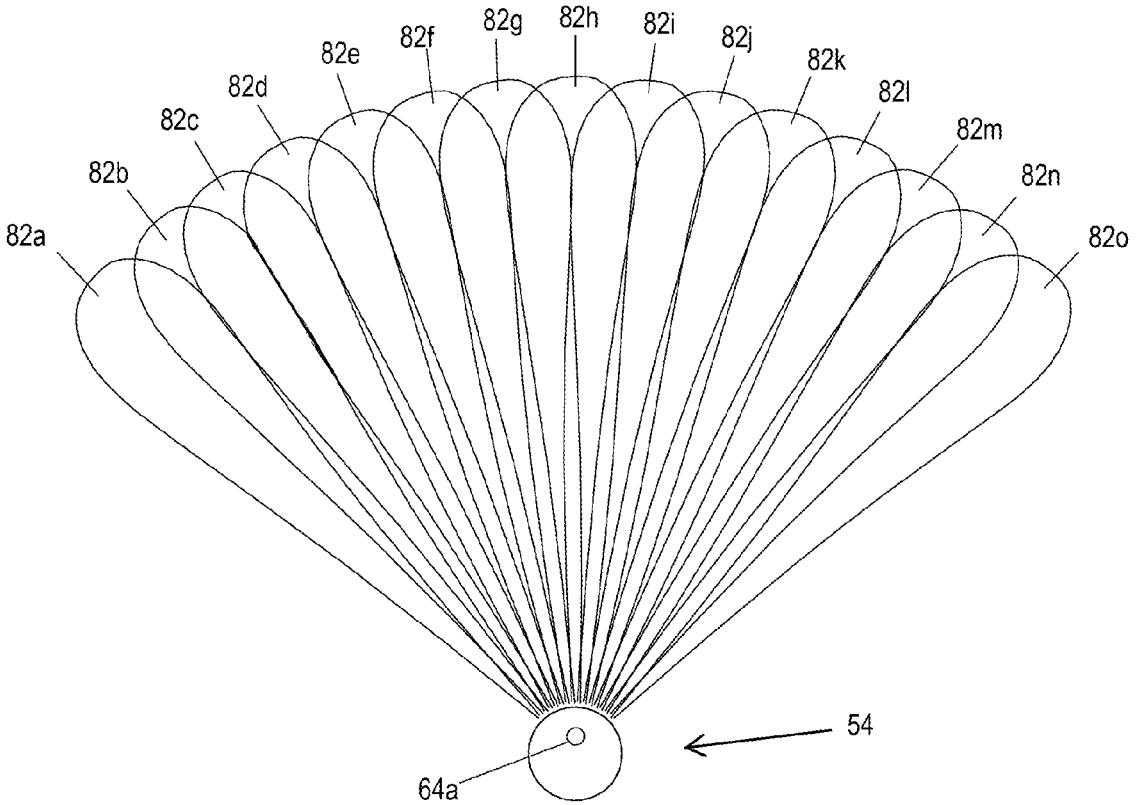
FIG. 18 is a graphic illustration of the water distribution pattern produced by the stream deflector of FIG. 17.
Figure 19A:
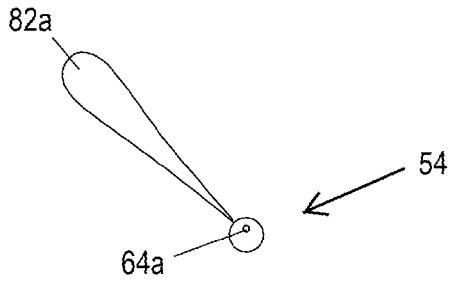
FIGS. 19A-19D graphically illustrate the progression of the wetted areas during the rotation of the stream deflector of FIG. 17 that combine to produce the water distribution pattern illustrated in FIG. 18.
Figure 19B:
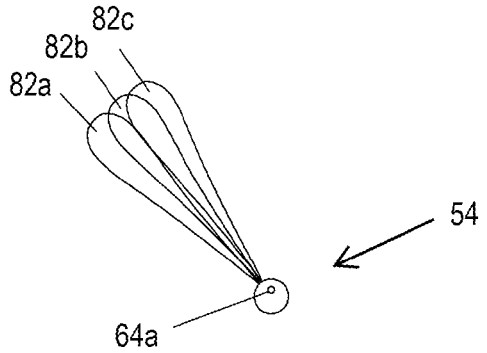
Figure 19C:
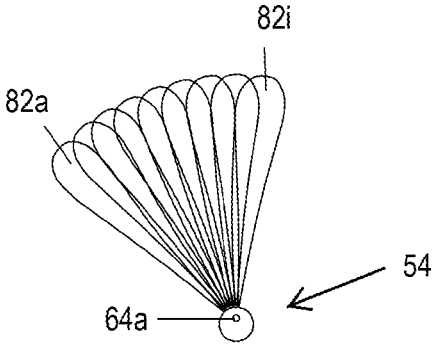
Figure 19D:
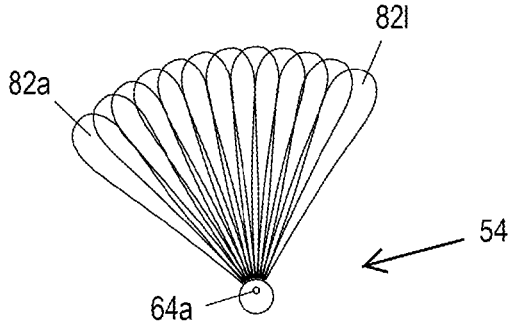

FIG. 17 illustrates the flutes 62*a*-62*o* of stream deflector 54 of FIGS. 10-13. The stream deflector 54 produces the water distribution pattern graphically illustrated in FIG. 18 as the stream deflector 54 rotates through one full revolution, i.e. three hundred and sixty degrees. The flutes labeled 62*a* through 62*o* in FIG. 17 lay down the tear-drop shaped water paths labeled 82*a* through 82*o* in FIG. 18 respectively. FIGS. 19A-19D further illustrate the order in which the water distribution pattern is produced. The orifice 64 is not visible from the top of the sprinkler 30. In FIG. 18, the small circle 64*a* represents the position of the orifice 64 in sprinkler 30. FIG. 19A illustrates the tear-drop shaped watering path 82*a* that is created by the water emitted from flute 62*a*. As the stream deflector 54 continues to slowly rotate, similar circumferentially spaced water paths 82*b* and 82*c* (FIG. 19B) are sequentially created by flutes 62*b* and 62*c*, respectively, passing over orifice 64. FIGS. 19C and 19D illustrate the manner in which the overall water distribution pattern increases in size as the stream deflector 54 continues to turn. The tear-drop shaped water path 82*i* is created as flute 62*i* passes over the orifice 64. This method of successively generating the tear-drop shaped water paths continues as illustrated in FIG. 19D. After the stream deflector 52 rotates through three hundred and sixty degrees, the generation of the water distribution pattern of FIG. 18 is complete.

Figure 20:
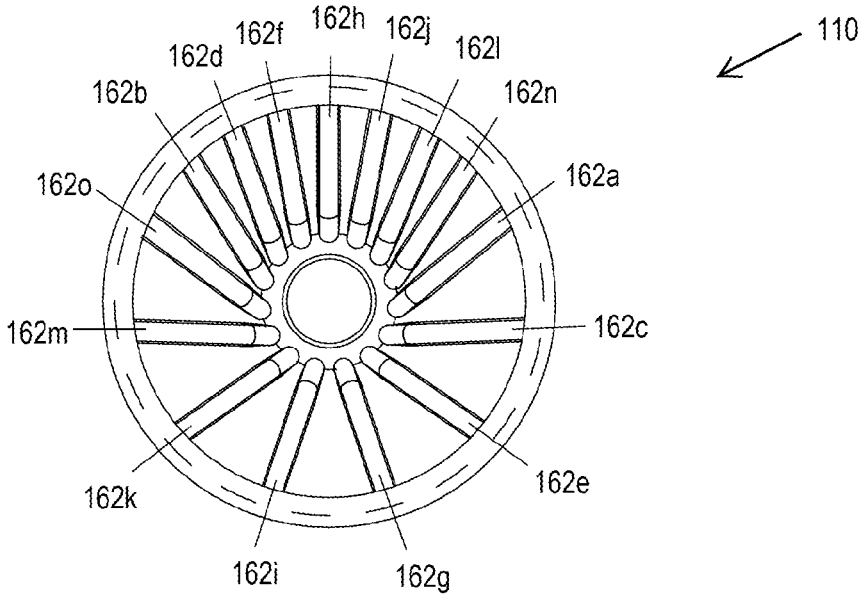
FIG. 20 is an enlarged bottom plan view of an alternate embodiment of a stream deflector that produces the water distribution pattern illustrated in FIGS. 20A-20C.
Figure 21A:
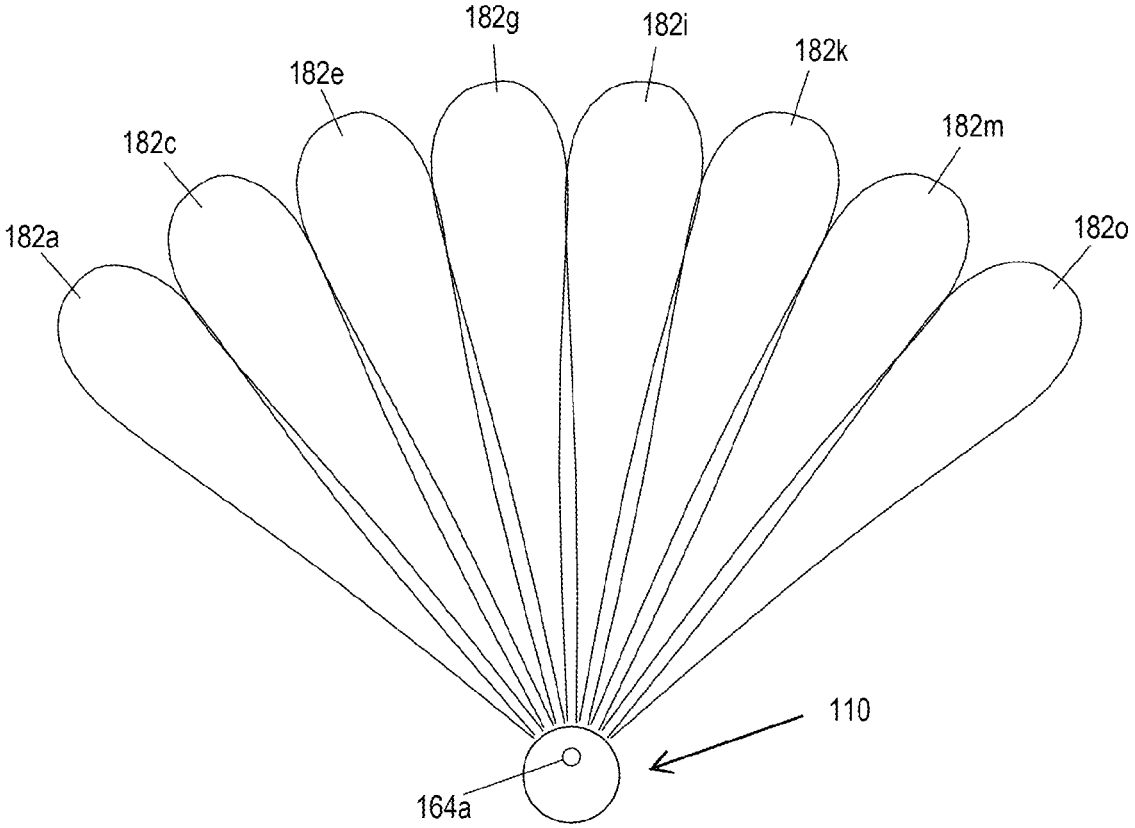
FIGS. 21A-21C graphically illustrate the water distribution pattern produced by the stream deflector of FIG. 20.
Figure 21B:
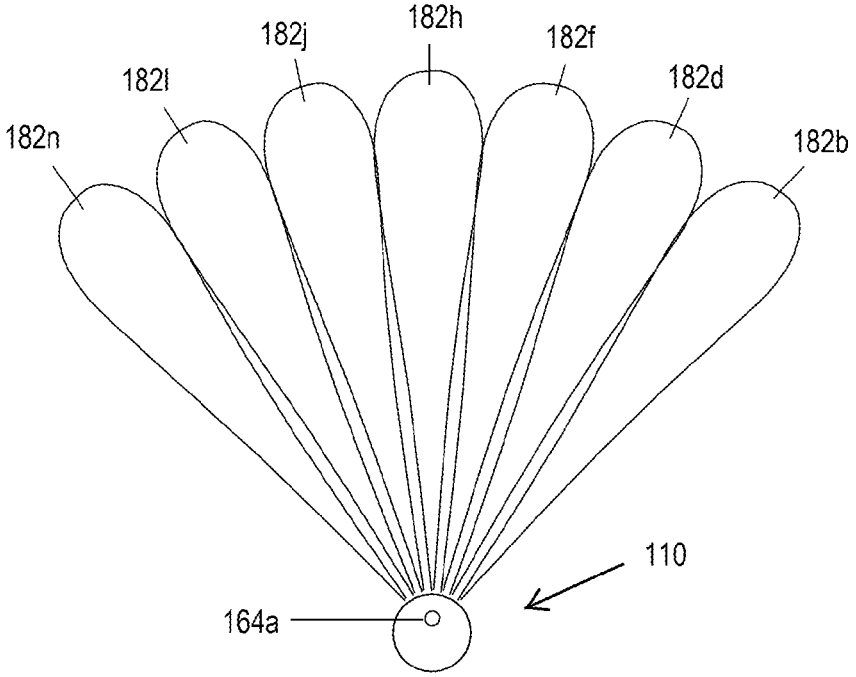
Figure 21C:
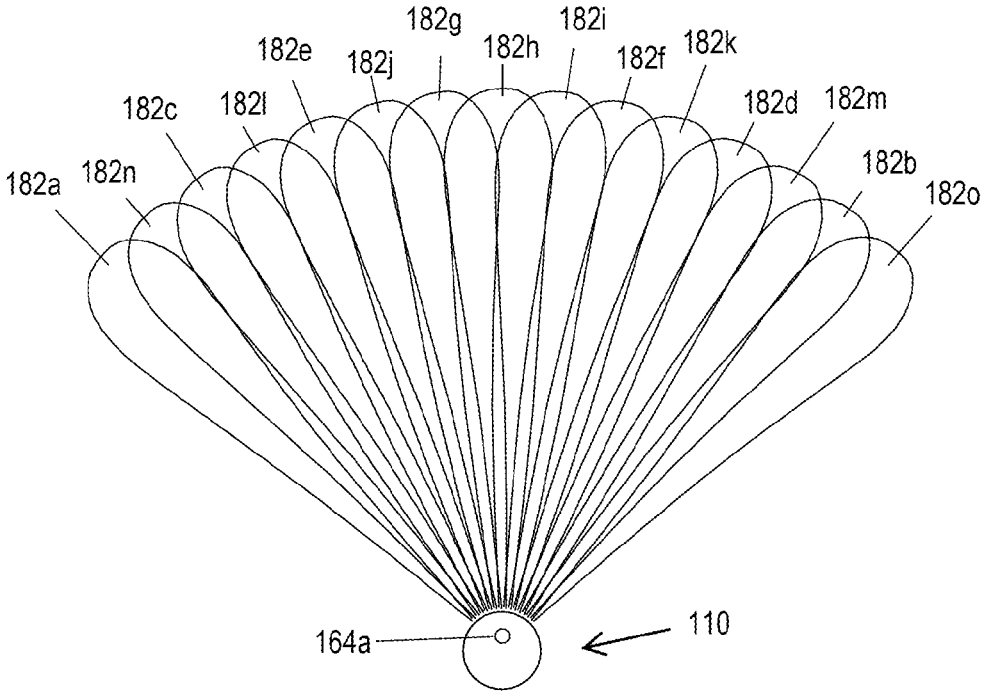

FIG. 20 illustrates an alternate embodiment of a stream deflector 110 that produces the water distribution pattern collectively illustrated in FIGS. 21A through 21C. In FIG. 20 the flutes 162*a* through 162*o* have the same angles as the similarly labeled flutes 62*a* through 62*o* of the stream deflector 54 of FIG. 17, respectively; however they are positioned differently relative to each other as illustrated in FIG. 20. During the first one-half revolution of the stream deflector 110 the flutes labeled 162*a*, 162*c*, 162*e*, 162*g*, 162*i*, 162*k*, 162*m* and 162*o* in FIG. 20 produce the tear-drop shaped water paths labeled 182*a*, 182*c*, 182*e*, 182*g*, 182*i*, 182*k*, 182*m* and 182*o* in FIG. 21A, respectively. The water is applied to the landscape successively via the tear-drop shaped water paths in the order given. During the second one-half revolution of the stream deflector 110 the flutes labeled 162*b*, 162*d*, 162*f*, 162*h*, 162*j*, 1621 and 162*n* in FIG. 20 produce the tear-drop shaped water paths labeled 182*b*, 182*d*, 182*f*, 182*h*, 182*j*, 1821 and 182*n* in FIG. 21B, respectively. The water is applied to the landscape successively via the tear-drop shaped water paths in the order given. FIG. 21C illustrates the combined watering pattern of FIGS. 21A and 21B that is created in one full revolution of the stream deflector 110

Collectively the water distribution pattern produced by the differently arranged flutes of the stream deflector 110 of FIG. 20 is similar to that of the stream deflector 54 of FIG. 17. Each flow path produced by the stream deflector 110 irrigates a different arc area and the combination of all arc areas defines the total irrigated area. The arc difference of the furthest flute 162*a* of the stream deflector 110 in one direction minus the furthest flute 162*o* of the stream deflector 110 in the opposite direction determines the shape of coverage of the stream deflector 102. At the furthest areas away from the sprinkler, the water distribution pattern area from the furthest flute in one direction does not overlap with the water distribution area of furthest flute in the opposite direction. A first set of flutes of the stream deflector 110 lays down a first series of water paths during a first portion of a single three hundred and sixty degree rotation of the stream deflector 110 and a second set of flutes of the stream deflector 110 lays down a second set of water paths that are interspersed with the first set of water paths during a second portion of the same three hundred and sixty degree rotation of the stream deflector 110.

Figure 22:
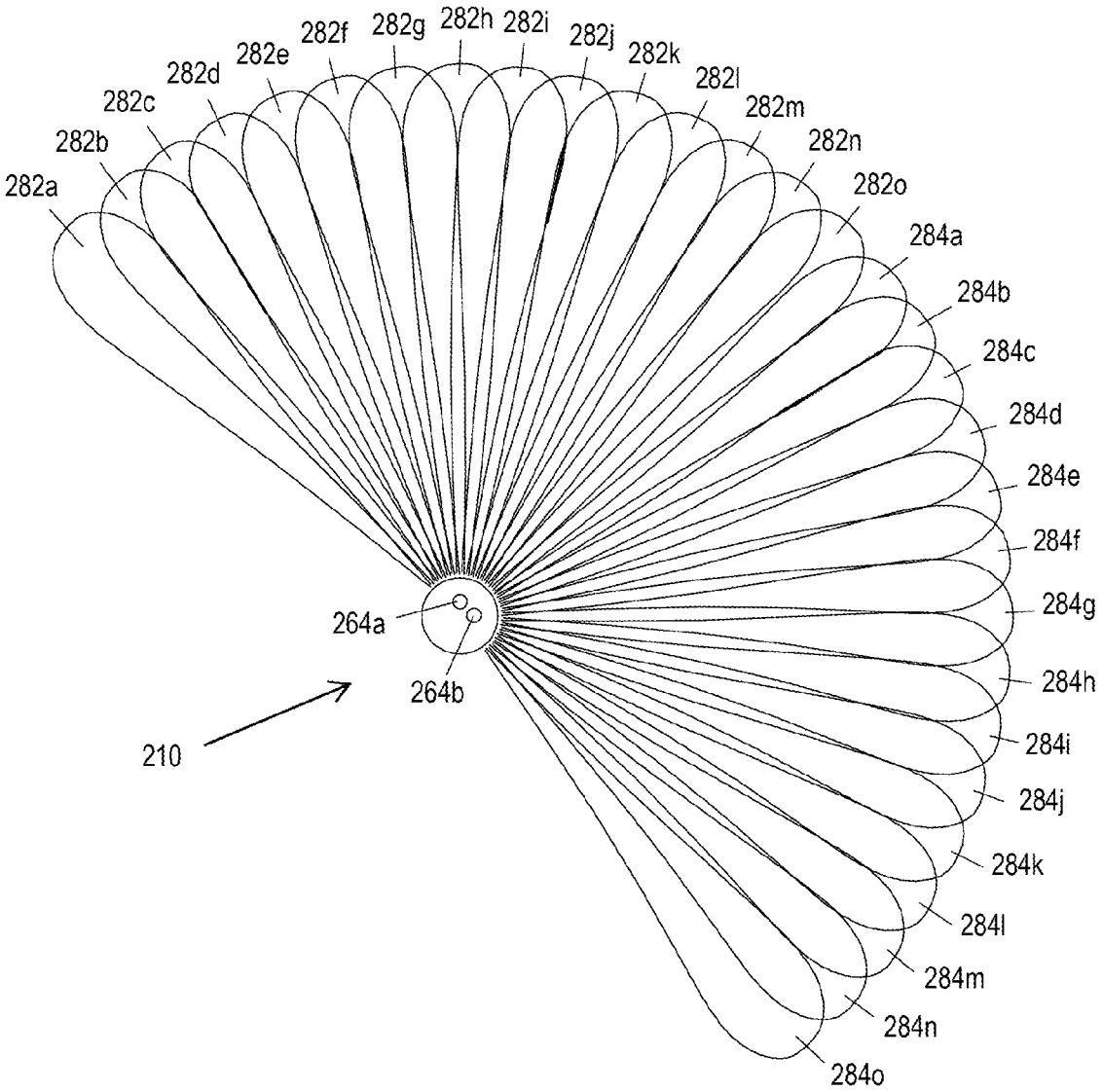
FIG. 22 graphically illustrates the water distribution pattern produced by the stream deflector of FIG. 17 with and second nozzle orifice in the nozzle plate to double the size of the water distribution area.

The total water distribution pattern area of the sprinkler can be increased in multiples of the designed pattern of the stream deflector plate by adding one or more nozzle orifices. FIG. 22 illustrates the total water distribution pattern of a sprinkler 210 with two nozzle orifices 264*a* and 264*b*. The nozzle orifice 264*b* is orientated approximately ninety degrees from the nozzle orifice 264*a*. The total water distribution pattern area in increased from approximately ninety degrees to a total water distribution area of approximately one hundred and eighty degrees using the stream deflector plate 54. The stream deflector 54 produces the water distribution pattern graphically illustrated in FIG. 22 as the stream deflector 54 rotates through one full revolution, i.e. three hundred and sixty degrees. As the flutes of the deflector plate 54 progressively pass in front of the nozzle orifice 264*a*, the water distribution pattern of 282*a* through 282*o* is produced. Simultaneously, as the flutes of the deflector plate 54 progressively pass in front of the nozzle orifice 264*b*, the water distribution pattern of 284*a* through 284*o* is produced.

Figure 23A:
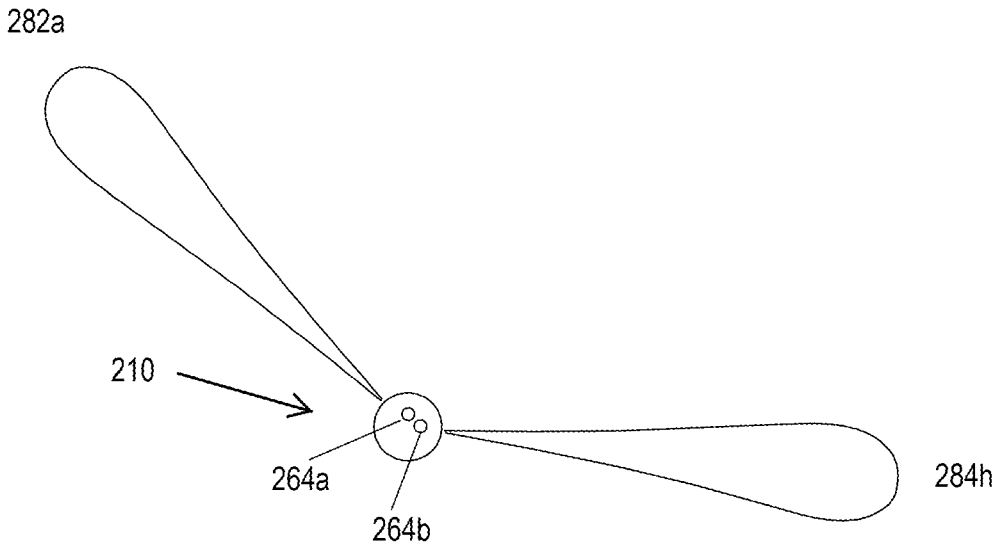
FIGS. 23A-23D are graphically illustrate the progression of the wetted areas during the rotation of the stream deflector that combine to provide the water distribution pattern of FIG. 22.
Figure 23B:
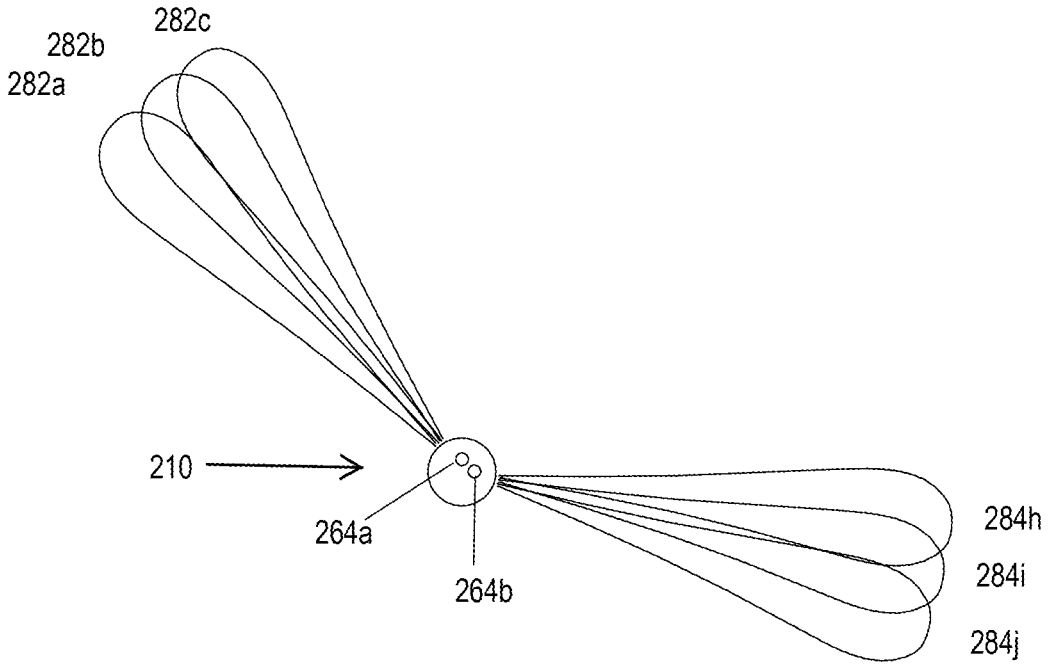

FIGS. 23A-23D illustrate how the watering pattern is produced. Referring to FIG. 23A, at a beginning point of a single full circle revolution of the deflector plate 54, the flute 62*a* is aligned with the orifice 264*a* and produces the tear-drop shaped water path labeled 282*a*. At the same time, flute 62*h* which is formed approximately ninety degrees circumferentially from the flute 62*a* is in alignment with the nozzle orifice 264*b* and produces the tear-drop shaped water path labeled 284*h*. As the deflector plate 54 continues to rotate, the tear-drop shaped water paths labeled 282*b* and

282*c* (FIG. 23B) are sequentially created simultaneously along with the tear-drop shaped water paths labeled 284*i* and 284*j*.

Figure 23C:
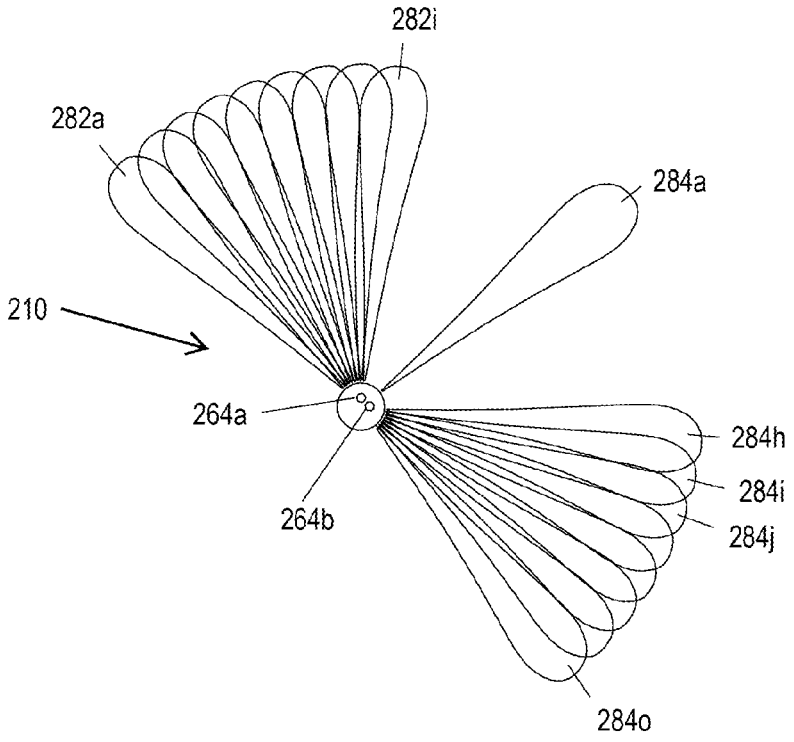

FIG. 23C illustrates the sequential generation of additional tear-drop shaped water paths that fill in the total shape of the desired shape of coverage. After approximately two hundred degrees of rotation of the deflector plate 54, flute 62*i* is aligned over orifice 264*a* to produce the tear-drop shaped water path labeled 282*i*. At the same time, flute 62*a* is aligned over orifice 264*b* and produces the tear-drop shaped water path labeled 284*a*. The deflector plate continues to rotate and sequentially produce additional tear-drop shaped water paths.

Figure 23D:
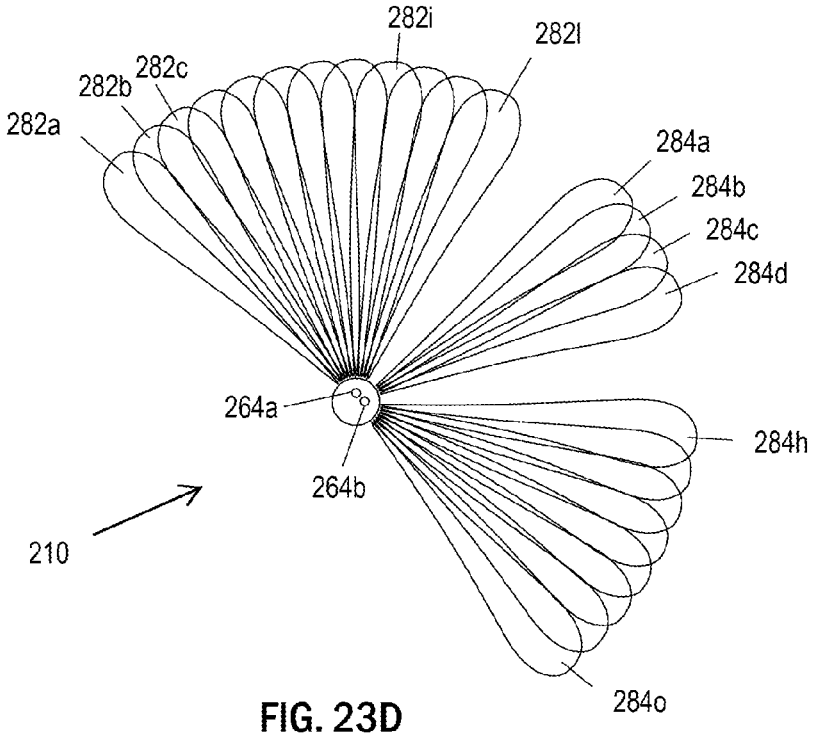

FIG. 23D illustrates the total water distribution pattern when it is nearly complete. At this stage, the tear-drop shaped water paths labeled 282*l* and 284*d* are simultaneously produced by their corresponding flutes in the stream deflector 54. This progression continues until the water distribution pattern illustrated in FIG. 22 is complete. The stream deflector 54 will continue to rotate until the sprinkler is turned OFF and continue to repeat producing the tear-drop shaped water paths until a desired amount of water had been applied to the landscape.

Figure 24:
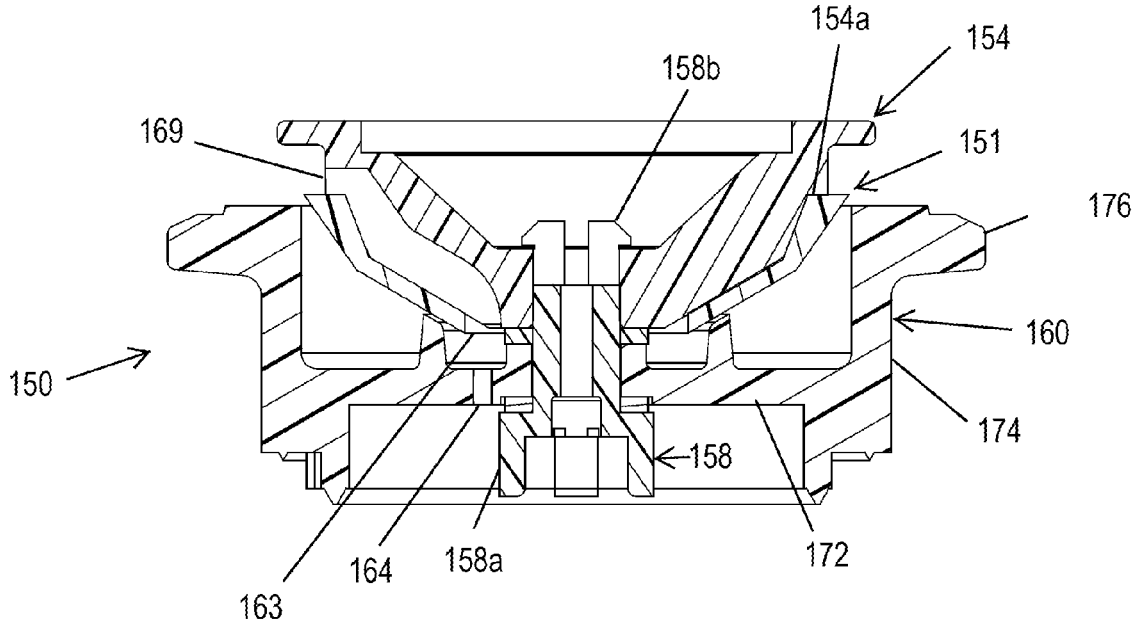
FIG. 24 is an enlarged vertical cross-sectional view of an alternate embodiment of a nozzle in accordance with the present invention that utilizes a cover beneath the stream deflector to enclose a majority of the radial length of the flutes.
Figure 25:
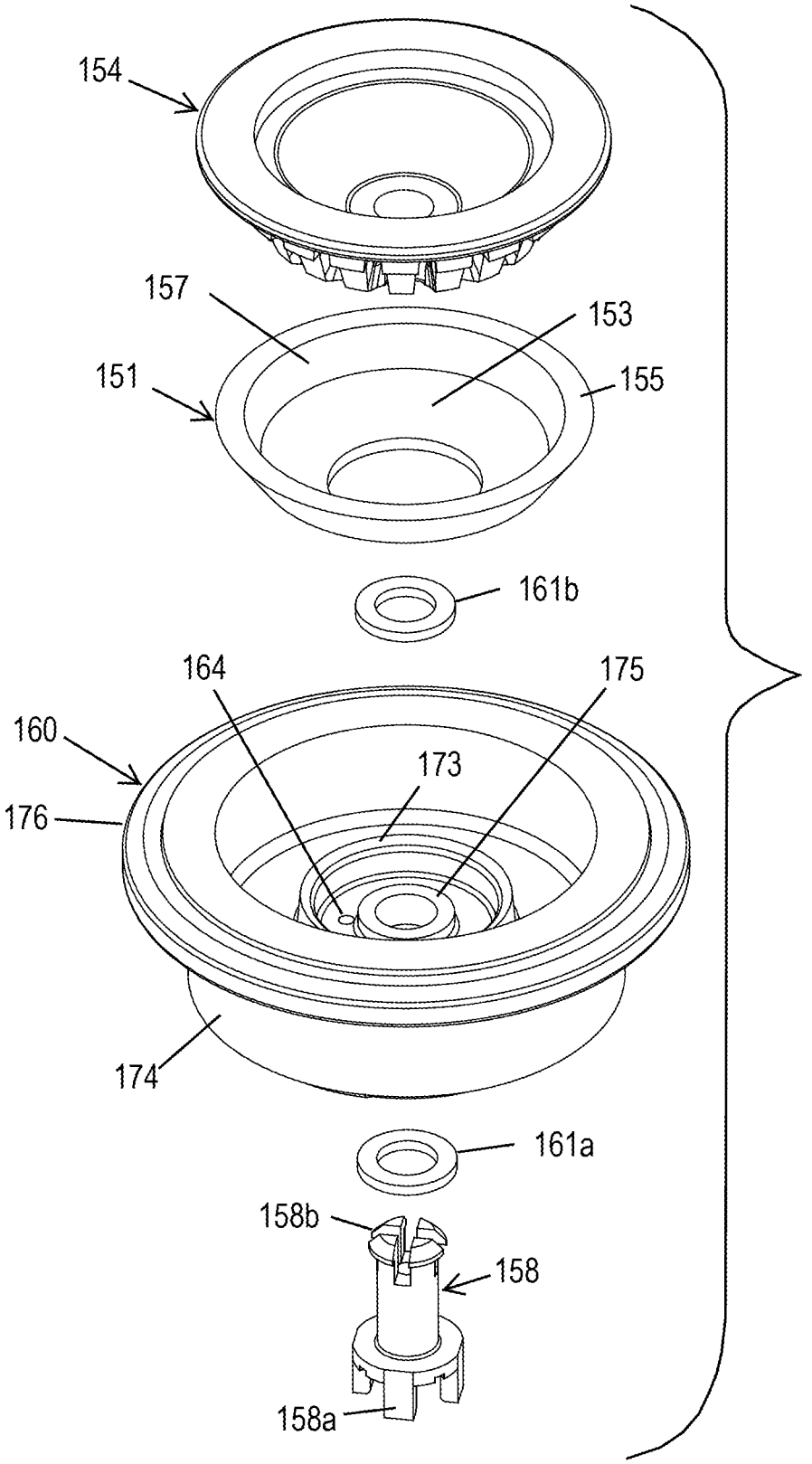
FIG. 25 is an exploded isometric view of the nozzle of FIG. 24 taken from above.
Figure 26:
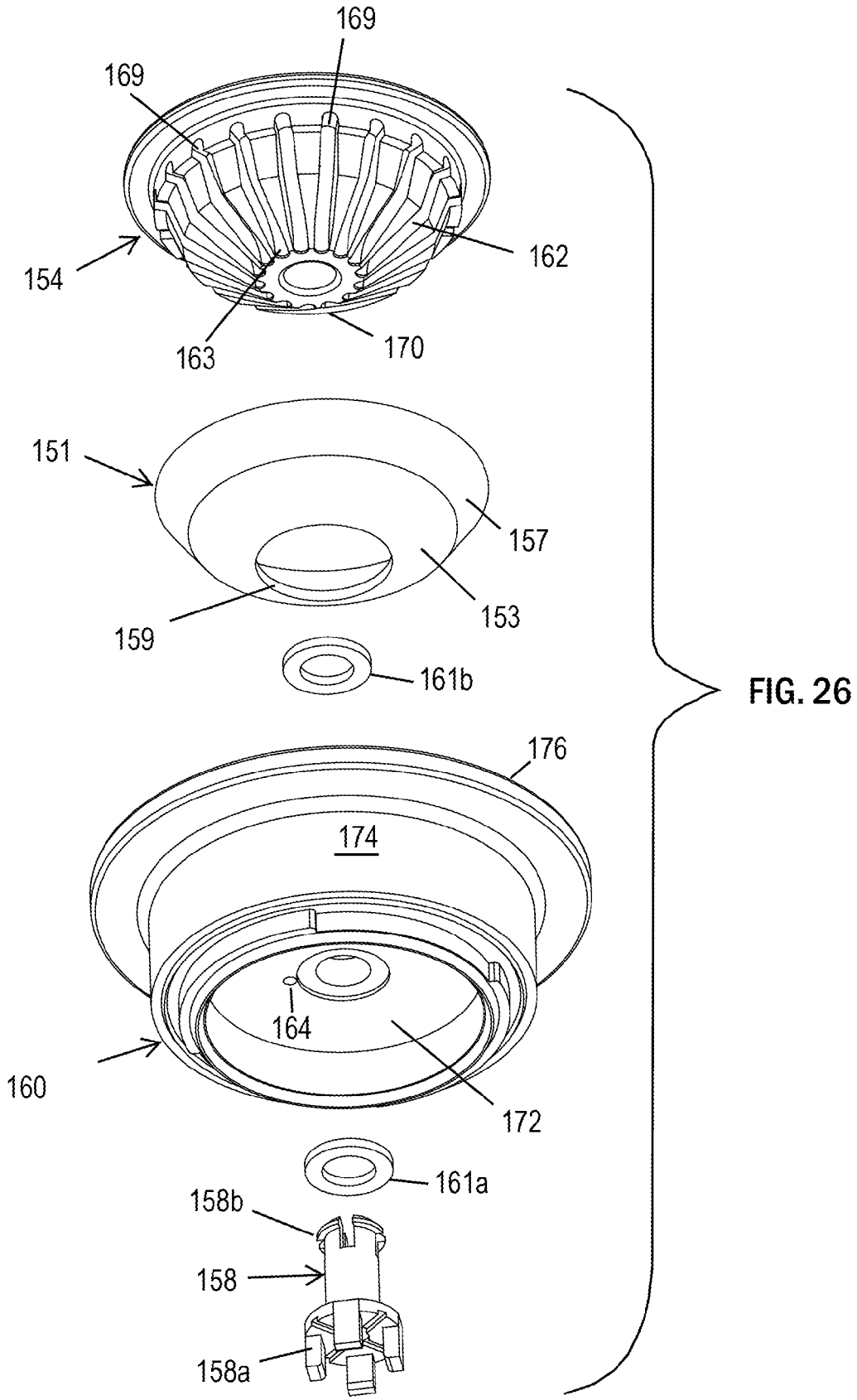
FIG. 26 is an exploded isometric view of the nozzle of FIG. 24 taken from below.

Referring to FIGS. 24-26, an alternate embodiment of a nozzle 150 in accordance with the present invention utilizes a cover 151 beneath a stream deflector 154 to seal a majority of the lengths of a plurality of radially directed flutes 162. A nozzle plate 160 has a central disk portion 172 with an orifice 164 formed therein. The nozzle plate 160 has a surrounding cylindrical collar 174 that terminates in an upper annular lip 176. The central disk portion 172 is also formed with an upwardly projecting annular rim 173 (FIG. 25) that concentrically surrounds a central collar or sleeve 175 of the central disk portion 172.

The nozzle 150 can be incorporated into a pop-up rotary stream sprinkler similar to that illustrated in FIG. 5. The stream deflector 154 (FIGS. 24-26) is driven in the same fashion as the stream deflector 54 of the embodiment illustrated in FIGS. 5-13). The upper end of the drive shaft 52 (FIG. 7) is coupled to the stream deflector 154 (FIG. 24) via the clutch dog 56 (FIG. 7) and a clutch member 158 (FIG. 26). The clutch dog 56 (FIG. 7) is rigidly coupled to the upper end of the drive shaft 52. The clutch member 158 (FIG. 24) has a clutch cup 158*a* at its lower end with four resilient fingers that grip the clutch dog 56 but release when the stream deflector 154 is manually rotated by a vandal, for example, to prevent damage to the gear train reduction 46 by back driving the same. The upper end of the clutch member 158 is formed with a retaining head 158*b* with a tapered peripheral lip and a diametric slot so that that the stream deflector 154 can be snap fit over the retaining head 158*b* as best seen in FIG. 24. The clutch dog 56, clutch member 158 and drive shaft 52 provide a means for drivingly connecting the output stage 50 of the gear train reduction 46 and the stream deflector 154. Bearings or seals 161*a* and 161*b* (FIG. 25) surround the clutch member 158 on either side of the nozzle plate 160.

Figure 27:
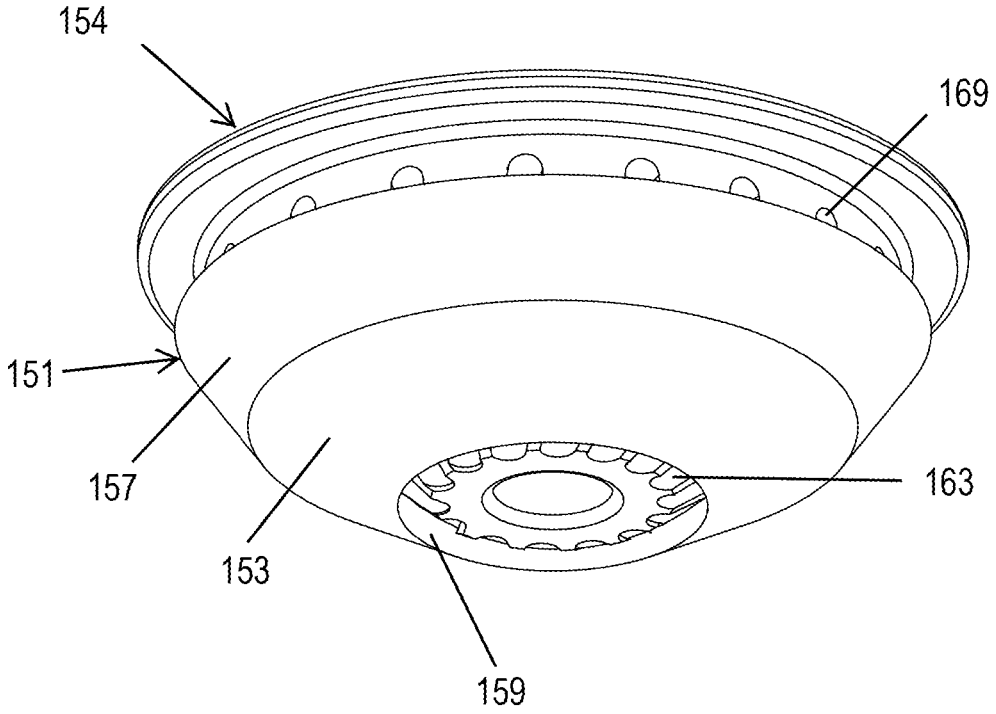
FIG. 27 is a still further enlarged isometric view of the cover and stream deflector of the nozzle of FIG. 24, taken from below.

Referring still to FIG. 25, the cover 151 has a generally frusto-conical configuration that conforms to the configuration of the underside of the stream deflector 154. An upper horizontal flange surface 155 of the cover 151 seats on a downwardly facing annular shoulder 154*a* of the stream deflector 154. The upper side of a first upwardly tapered surface 153 of the cover 151 is secured, e.g. by sonic welding, solvent welding, a snap fit, or other bonding method, to the underside of the stream deflector 154. Thus the cover 151 and the stream deflector 154 cooperate to define flutes that are completely enclosed along a portion of their radial lengths. As best seen in FIG. 26, the cover 151 has a central round opening 159 formed in the center of the first upwardly tapered surface 153. The cover 151 is formed with a second upwardly tapered surface 157. The combined radial dimension of the first and second upwardly tapered surfaces 153 and 157 is sufficient to enclose a majority of the radial lengths of the flutes 162 formed in the underside of the stream deflector 154. Referring to FIG. 27, the cover 151 cooperates with the stream deflector 154 to define a plurality of stream inlet ports 163 comprising the lower ends of the flutes 162 and a plurality of stream outlet ports 169 comprising the upper ends of the flutes 162. The diameter of the round opening 159 is just large enough to reveal the lower ends of the flutes 162.

Figure 28:
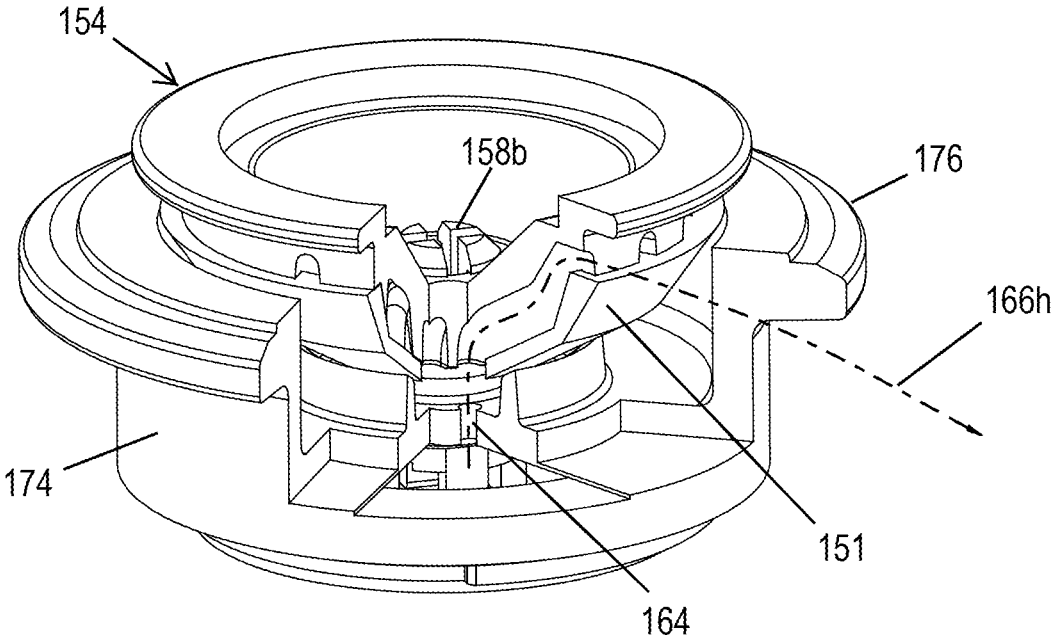
FIG. 28 is an isometric view of the nozzle of FIG. 24 with portions cut away to reveal further details of its structure and operation. The water flow path through one of the flutes of the stream deflector is illustrated with a phantom line that terminates in an arrow head representing a stream of water being ejected from the nozzle.

Referring to FIG. 28, as the stream deflector 154 slowly rotates water that is ejected upwardly from the orifice 164 in the nozzle plate 160 momentarily enters each of the flutes 162 through its inlet port 163, is channeled through that flute 162, and is ejected radially outwardly therefrom through its outlet port 169. In FIG. 28 the water flow path through one of the flutes 162 of the stream deflector 154 is illustrated with a phantom line 166*h* that terminates in an arrow head representing a stream of water being ejected from the nozzle 160. In FIG. 28 the stream 166*h* is illustrated as having a nearly horizontal trajectory. However the water stream 166*h* could be inclined at a suitable angle, depending upon the reach or radius required for the particular irrigation application.

Figure 29:
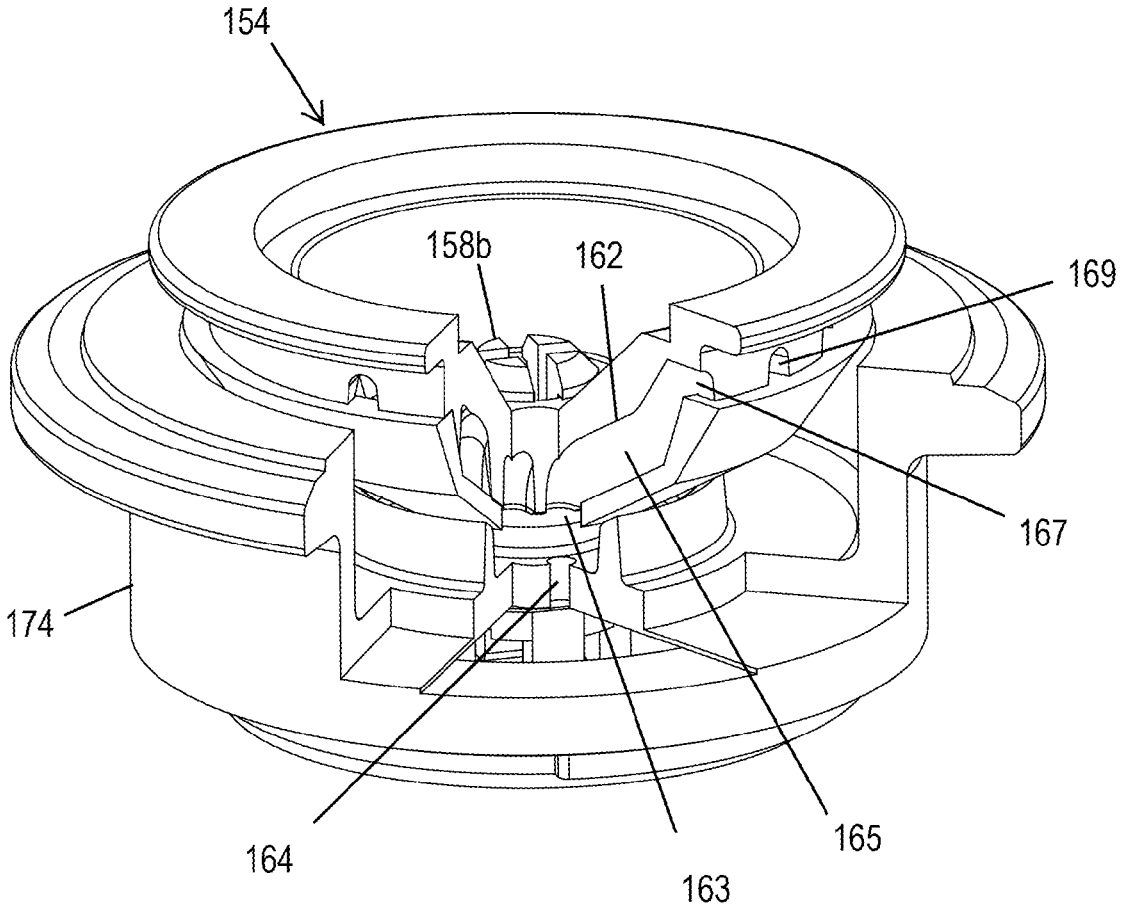
FIG. 29 is a view similar to FIG. 28, which has been enlarged further to better illustrate the configuration of flutes on the stream deflector of this alternate embodiment that creates a high pressure accumulation chamber and a higher velocity of the water exiting the flute.

FIG. 29 illustrates the configuration of the flutes 162 on the stream deflector of this alternate embodiment. This flute configuration creates a higher velocity of the water exiting each of the flutes 162. More particularly, an intermediate segment 165 of each of the flutes 162 has a larger cross-sectional area than that of either the inlet port 163 or the outlet port 169, thereby creating the high pressure accumulation chamber. The combination of the stream deflector 154 and the cover 161 and the novel configuration of the flutes 162 result in a better defined stream 166*h*. The nozzle 160 is thus able to achieve a more precise and uniform shape of coverage in terms of the irrigated area even though the nozzle 160 is operating at a very low flow rate, e.g. 3.6 gallons per hour or less.

While I have described and illustrated several embodiments of a pop-up sprinkler with an improved rotary stream nozzle in detail, it should be apparent to those skilled in the art that my invention can be modified in arrangement and detail. For example, there may be a stator or bias opening above the turbine 38 for flow requirements from a larger nozzle, increased arc or increased radius. The stream deflector plate may be designed to produce an arc of coverage that is more or less than ninety degrees. The rotary stream sprinkler 30 may have one or more nozzle orifices and can be designed to provide a shape of coverage that is a full circle. The shape of coverage can also take other shapes, such as semi-circular, square, rectangular, oval, thin strip, or any other shape employed in commercial and residential irrigation. Other components may be included to control the radius. The rotary stream sprinkler 30 may include an alternate nozzle plate that has multiple orifices so that the nozzle simultaneously ejects multiple streams of water. Therefore, the protection afforded my invention should only be limited in accordance with the following claims.

We claim:

1. A sprinkler nozzle, comprising:

a sprinkler axis;

a nozzle plate having at least one orifice formed therein; and a stream deflector rotatably mounted adjacent the nozzle plate and having a plurality of flutes formed therein facing the nozzle plate, each flute having an inner portion that can momentarily align with a center of a first orifice in the nozzle plate during rotation of the stream deflector about the sprinkler axis relative to the nozzle plate so that water flowing through the first orifice will be channeled in a generally radial direction by the flute to form a stream of water that is ejected from the stream deflector, and further wherein a first flute extends in a first direction at a first angle in a plane perpendicular to the rotational axis of the stream deflector with respect to a line intersecting the sprinkler axis and the center of the first orifice when the inner portion of the first flute aligns with the center of the first orifice, wherein a second flute extends in a second direction at a second angle a plane perpendicular to the rotational axis of the stream deflector with respect to a line intersecting the sprinkler axis and the center of the first orifice when the inner portion of the second flute aligns with the center of the first orifice, wherein the plurality of flutes includes at least one flute other than the first and second flutes, wherein all of the plurality of flutes other than the first flute and the second flute extend in directions at angles between the first and second angles when the inner portion of each of the plurality of flutes aligns with the center of the first orifice, so that in combination the streams of water successively ejected from the stream deflector establish a predetermined shape of coverage entirely between the first direction and the second direction after the stream deflector rotates through an entire revolution, and wherein the first orifice in the nozzle plate is a single aperture offset from a center of the nozzle plate.

2. The sprinkler nozzle of claim 1 wherein the flutes are formed so that successive streams of water extend at different angles.

3. The sprinkler nozzle of claim 1 wherein the flutes are generally straight and an axis of at least some of the flutes does not intersect the sprinkler axis.

4. The sprinkler nozzle of claim 1 wherein the first orifice is radially offset from the sprinkler axis.

5. The sprinkler nozzle of claim 1 wherein at least some of the flutes extend in a tangential fashion relative to a rotational center of the stream deflector.

6. The sprinkler nozzle of claim 1 where a wetted area furthermost away from the nozzle generated by the alignment of the first orifice with the first flute in the first direction does not overlap with a wetted area generated by the alignment of the first orifice with the second flute in the second direction.

7. The sprinkler nozzle of claim 1 wherein the nozzle plate has more than one orifice offset from a center of the nozzle plate to increase the area of coverage.

8. The sprinkler nozzle of claim 1 wherein the plurality of flutes comprises fifteen flutes, including the first and second flutes.

9. A sprinkler nozzle, comprising:

a nozzle plate having at least one orifice formed therein; and a stream deflector rotatably mounted adjacent the nozzle plate and configured to rotate about a rotational axis with respect to the nozzle plate, the stream deflector having a plurality of flutes formed therein facing the nozzle plate configured so that during rotation of the stream deflector relative to the nozzle plate each flute can form a stream of water that is ejected from the stream deflector such that a first flute ejects a first stream of water in a first direction when the first flute is aligned with a center of a first orifice and a second flute ejects a second stream of water in a second direction different from the first direction when the second flute is aligned with a center of the first orifice, wherein the plurality of flutes includes at least one flute other than the first and second flutes, and wherein each other flute other than the first and second flutes ejects a stream of water in a direction between the first direction and the second direction when each other flute is aligned with a center of the first orifice, wherein the flutes are configured so that a shape of coverage produced by a combination of streams of water successively ejected from the stream deflector is independent of the shape and size of the first orifice in the nozzle plate, and wherein the first orifice in the nozzle plate is a single aperture offset from a center of the nozzle plate.

10. The sprinkler nozzle of claim 9 wherein the flutes have a plurality of different lateral trajectories relative to the first orifice in the nozzle plate so that in combination the streams of water successively ejected from the stream deflector establish a predetermined shape of coverage entirely between the first direction and the second direction.

11. The sprinkler nozzle of claim 10 wherein the flutes are generally straight and an axis of at least some of the flutes does not intersect a rotational axis of the stream deflector.

12. The sprinkler nozzle of claim 10 wherein the shape of coverage is solely determined by the trajectory of the flutes formed in the stream deflector.

13. The sprinkler nozzle of claim 9 wherein the plurality of flutes comprises fifteen flutes, including the first and second flutes.

* * * * *